US006990920B2

(12) United States Patent
Hamilton et al.

(10) Patent No.: US 6,990,920 B2
(45) Date of Patent: Jan. 31, 2006

(54) ADJUSTABLE SEATING SYSTEM

(75) Inventors: Murray W. Hamilton, LaConner, WA (US); Andrew S. Galdwin, Brentwood Bay (CA); Gary Seaman, Bellingham, WA (US); Raymond H. Klein, II, Milwaukee, WI (US); David E. Vanderveen, Chilliwack (CA)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 10/144,691

(22) Filed: May 13, 2002

(65) Prior Publication Data

US 2002/0175549 A1 Nov. 28, 2002

Related U.S. Application Data

(60) Provisional application No. 60/290,425, filed on May 11, 2001.

(51) Int. Cl.
*B63B 17/00* (2006.01)

(52) U.S. Cl. ..... 114/363; 114/347

(58) Field of Classification Search ..... 114/363, 114/347

See application file for complete search history.

(56) References Cited

U.S. PATENT DOCUMENTS

| | | | | |
|---|---|---|---|---|
| 430,218 | A | 6/1890 | O'Leary | |
| 1,852,012 | A | 4/1932 | Hose | |
| 2,508,769 | A | 5/1950 | Osbon et al. | 155/133 |
| 2,999,253 | A | 9/1961 | Lewis | |
| 3,215,470 | A | 11/1965 | Swenson et al. | |
| 3,990,743 | A | 11/1976 | Nelson | |
| 4,229,850 | A | 10/1980 | Arcouette | |
| 4,498,702 | A | 2/1985 | Raftery | |
| 4,503,799 | A | 3/1985 | Masters | |
| 4,521,053 | A | 6/1985 | de Boer | |
| 4,541,669 | A | 9/1985 | Goldner | |
| 4,589,365 | A | 5/1986 | Masters | |
| 4,664,444 | A | 5/1987 | Murphy | |
| 4,693,204 | A | 9/1987 | Klein | |
| 4,709,961 | A | 12/1987 | Hill | |
| 4,727,821 | A | 3/1988 | Masters | |
| 4,747,821 | A | 5/1988 | Masters | |
| 4,843,999 | A | 7/1989 | Kobus et al. | |
| 4,930,171 | A | 6/1990 | Frantz | |
| 5,042,416 | A | 8/1991 | Arcouette | |
| 5,144,708 | A | 9/1992 | Pekar | 5/454 |
| 5,224,891 | A | 7/1993 | Stephens | |
| 5,331,916 | A | 7/1994 | Martin | |

(Continued)

FOREIGN PATENT DOCUMENTS

| | | |
|---|---|---|
| DE | 1255517 | 11/1967 |
| FR | 1.519.843 | 2/1968 |
| GB | 2 331 235 | 5/1999 |

OTHER PUBLICATIONS

PCT International Search Report for International Application No. PCT/US 02/14989 (5 pages).

(Continued)

*Primary Examiner*—Jesús D. Sotelo
(74) *Attorney, Agent, or Firm*—Reinhart Boerner Van Deuren P.C.

(57) ABSTRACT

A seating system for use in a watercraft is disclosed. The seating system comprises a seat pan adapted to be mounted to the watercraft, a pad coupled to the seat pan and adapted to provide a seating surface for the user, and a back rest coupled to the seat pan. The seating system further comprises a first adjustment mechanism configured to provide for and aft adjustment of the seating position, a second adjustment mechanism configured to provide adjustment of the back rest without having to exit the watercraft, and a third adjustment mechanism configured to provide adjustment of the seating surface.

34 Claims, 12 Drawing Sheets

U.S. PATENT DOCUMENTS

| | | | | |
|---|---|---|---|---|
| 5,356,201 | A | 10/1994 | Olson | 297/352 |
| 5,374,022 | A | 12/1994 | Gilmer, Jr. et al. | 248/396 |
| 5,419,614 | A | 5/1995 | Richards et al. | |
| 5,493,982 | A | 2/1996 | Carpenter et al. | |
| 5,556,258 | A | 9/1996 | Lange et al. | 417/63 |
| 5,597,203 | A | 1/1997 | Hubbard | |
| 5,619,949 | A | 4/1997 | Dick, Jr. | |
| 5,622,403 | A | 4/1997 | Gonda | |
| 5,868,096 | A | 2/1999 | Elvestad | |
| 5,970,903 | A | 10/1999 | McDonough et al. | 114/347 |
| 5,988,098 | A | 11/1999 | Hillhouse | |
| 6,022,255 | A | 2/2000 | Lukanovich | |
| 6,035,799 | A | 3/2000 | Lukanovich et al. | |
| 6,079,349 | A | 6/2000 | Simpson | |
| 6,105,531 | A | 8/2000 | Knight | |
| 6,112,693 | A | 9/2000 | Addison | |
| 6,152,063 | A | 11/2000 | Niemier | |
| 6,178,912 | B1 | 1/2001 | Niemier | |
| 6,189,971 | B1 | 2/2001 | Witzig | |
| 6,305,311 | B1 | 10/2001 | Cooke | |
| 6,386,633 | B1 | 5/2002 | Newton | |
| 6,443,089 | B1 | 9/2002 | Goucher et al. | |
| 6,729,259 | B2 | 5/2004 | Jerabek et al. | |
| 6,736,084 | B2 | 5/2004 | McDonough et al. | |

OTHER PUBLICATIONS

Emlen, Andrew, Anatomic Back Band by North Shore, Inc., Sea Kayaker, Aug., 2001, 2 pages.

Bladders Technology & Design brochure, Dielectrics Industries, copyright 1994, 6 pages.

Pyranha at OR 2000, http://www.outdoorplay.com/news/pyranhaOR.html, printed on Aug. 31, 2001, 1 page Wilderness Systems, Phase$^3$ Outfitting, printed from www.wildernesssystems.com on Oct. 1, 2002, Believed to have been publicly shown in Aug., 2001, 1 page.

Photographs of a Wavesport XXX; believed to have been commercially available before Aug. 6, 2001.

Photographs of a Liquid Logic Tryon, believed to have been commercially available since at least 2001.

Wave Sport, Whitewater Kayaks, Catalogue, bearing a designation of "©Wave Sport, 1999".

Kajak Sport, Catalogue, bearing a designation of "1999–2000".

Riot, Catalogue, bearing a designation of "2001".

Great River Outfitters, Product Catalog, bearing a designation of "Demo Day on May 5th, 2001".

ADJUSTABLE SEATING SYSTEM

CROSS-REFERENCE TO RELATED APPLICATIONS

The present invention claims priority from U.S. Provisional Patent Application No. 60/290,425 titled "Adjustable Seating System" filed May 11, 2001, the full disclosure of which is hereby incorporated herein by reference.

FIELD OF THE INVENTION

The present invention relates to seating systems. In particular, the present invention relates to seating systems that are adjustable to accommodate different anatomies. Even more particular, the present invention relates to adjustment seating systems for use in kayaks or other similar watercraft.

BACKGROUND OF THE INVENTION

Sit-in kayaks typically include a hull having a bottom, sides and a top with an opening allowing a kayaker to sit inside the kayak. Such kayaks are typically provided with a seat disposed within the opening inside the kayak and a pair of thigh pads or braces secured to an inside surface of the top of the kayak. The seat typically includes a seat pan upon which a user's buttock rests, a back rest disposed behind the seat pan, and hip pads located on opposite sides of the seat pan. To accommodate different anatomies, the back rest is typically provided with an adjustable height by an adjustment mechanism typically located behind the back rest. Because the adjustment mechanism is located behind the back rest, any such adjustment must be performed while the kayaker is not seated within the kayak. As a result, attaining a proper back rest height requires that a kayaker repeatedly exit and adjust the seat back rest. The hip pads are typically not adjustable in that such pads are usually cut and customized for one particular kayaker's anatomy. Once customized, such hip pads may not be usable with other kayakers having different anatomies.

The thigh pads or braces typically extend along an inside surface of a top of the kayak forward the opening and underlying cockpit. Such thigh pads are provided as a bearing surface against which the kayaker may brace his or her thighs when positioned within the kayak. Although stabilizing the kayaker within the hull of the kayak, such thigh pads are typically excessively spaced from the internal bottom of seat pan, requiring the kayaker to bend his or her knees and to possibly assume an unnatural and uncomfortable posture within the kayak. Alternatively, the thigh pads or braces may be too closely spaced to the internal bottom of the kayak or the seat pan which results in the brace pads or braces excessively and uncomfortably pinching the kayaker's legs.

Thus, there is a continuing need for a seating system for a kayak that accommodates different anatomies. In particular, there is a continuing need for a kayak seating system having an easily adjustable back rest. There is also a continuing need for a kayak seating system having easily adjustable hip pads which may be adjusted for multiple kayakers having different anatomies. Furthermore, there is a continuing need for a kayak seating system that enables a kayaker to assume a natural or comfortable posture within the kayak while attaining sufficient bracing.

SUMMARY OF THE INVENTION

The present invention relates to a seating system for use in a watercraft and configured to provide an adjustable seating position for a user of the watercraft. The seating system comprises a seat pan adapted to be mounted to the watercraft, a pad coupled to the seat pan and adapted to provide a seating surface for the user, and a back rest coupled to the seat pan. The seating system further comprises a first adjustment mechanism configured to provide for and aft adjustment of the seating position, a second adjustment mechanism configured to provide adjustment of the back rest without having to exit the watercraft, and a third adjustment mechanism configured to provide adjustment of the seating surface.

The present invention also relates to a seating system for use in a watercraft and configured to provide a seating position for a user of the watercraft. The seating system comprises a seat pan adapted to be mounted to the watercraft, a pad coupled to the seat pan and adapted to provide a seating surface for a user of the watercraft, a back rest coupled to the seat pan, and an adjustment mechanism configured to provide height adjustment to the back rest. The first adjustment mechanism comprises a first member coupled to the back rest and a second member pivotally coupled to the seat pan. The back rest, first member and second member pivot between a first position where the back rest is retained in place and a second position where the first member and back rest are slidably movable relative to the second member.

The present invention further relates to a seating system for use in a watercraft and configured to provide an adjustable seating position for a user of the watercraft. The seating system comprises a seat pan adapted to be mounted to the watercraft, a pad coupled to the seat pan and adapted to provide a seating surface for a user of the watercraft, a back rest coupled to the seat pan, an adjustment mechanism configured to provide fore and aft adjustment of the seating position, a rope coupling the back rest to the adjustment device. The adjustment mechanism comprises a strap and a locking device. The strap has a first end coupled to the rope and a second end releasably retained by the locking device.

The present invention further relates to a seating system for use in a watercraft and configured to provide a seating position for a user of the watercraft. The seating system comprises a seat pan adapted to be mounted to the watercraft, a pad coupled to the seat pan and adapted to provide a seating surface for a user of the watercraft, a back rest coupled to the seat pan, and an adjustment mechanism configured to provide adjustment of the seating surface. The seating surface is movable between a first position and a second position.

The present invention further relates to a seating system for use in a watercraft and configured to provide a seating position for a user of the watercraft. The seating system comprises a seat pan adapted to be mounted to the watercraft, a pad coupled to the seat pan and adapted to provide a seating surface for a user of the watercraft, a back rest coupled to the seat pan, a means for adjusting the height of the back rest, means for adjusting the fore and aft sitting position; and means for adjusting the support provided by the cushion.

The present invention further relates to a method of adjusting a seating position provided by a seating system for use in a watercraft. The method comprises providing a seat pan adapted to be mounted to the watercraft, a pad adapted to provide a seating surface for a user, a back rest coupled to the seat pan, and a first adjustment mechanism, operating the first adjustment mechanism to adjust the seating position of the user without the user having to exit the watercraft.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Figure 1:
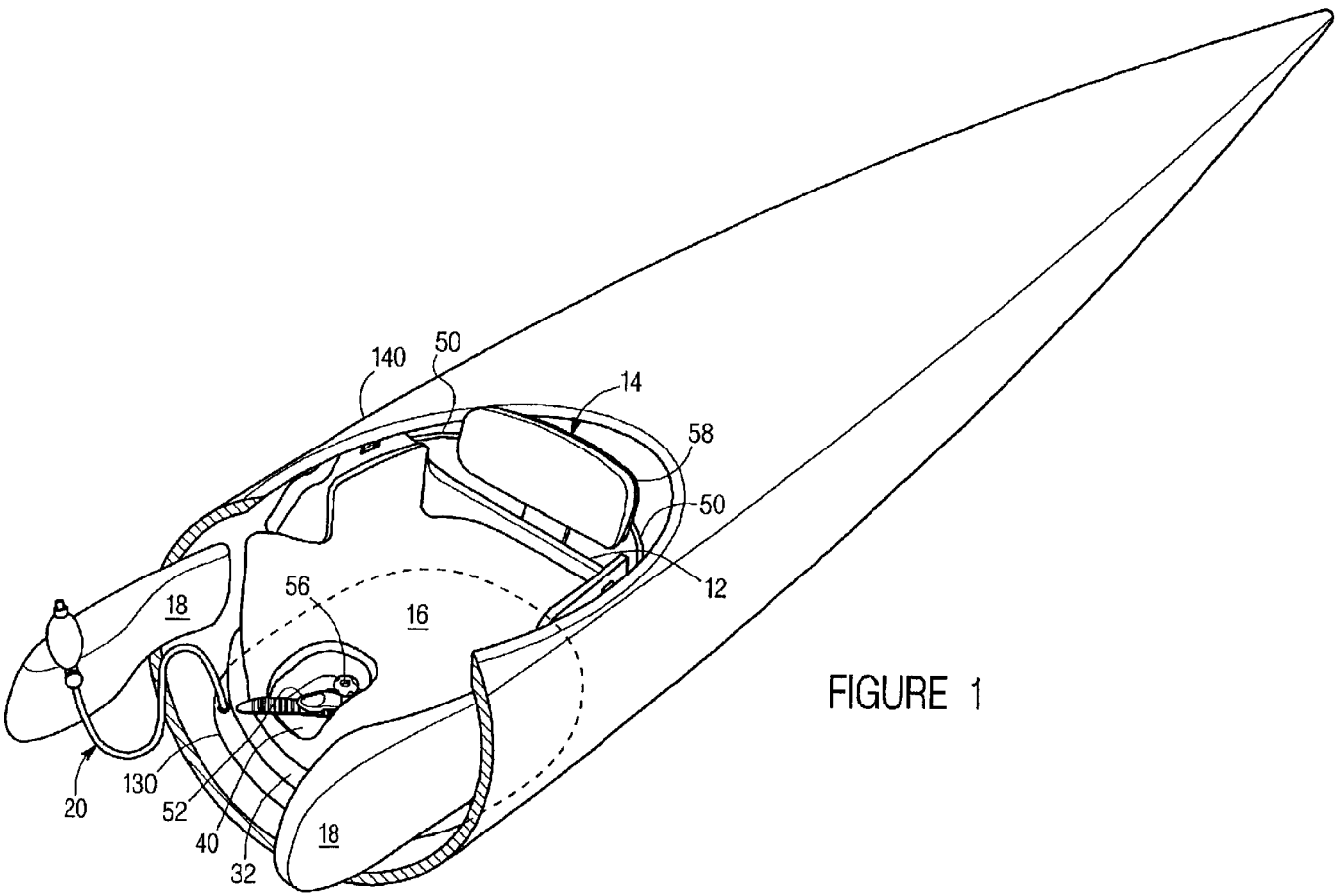
FIG. 1 is a fragmentary perspective view of a kayak with a seating system according to a preferred embodiment.

Before explaining a number preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF PREFERRED AND OTHER EXEMPLARY EMBODIMENTS

Figure 2:
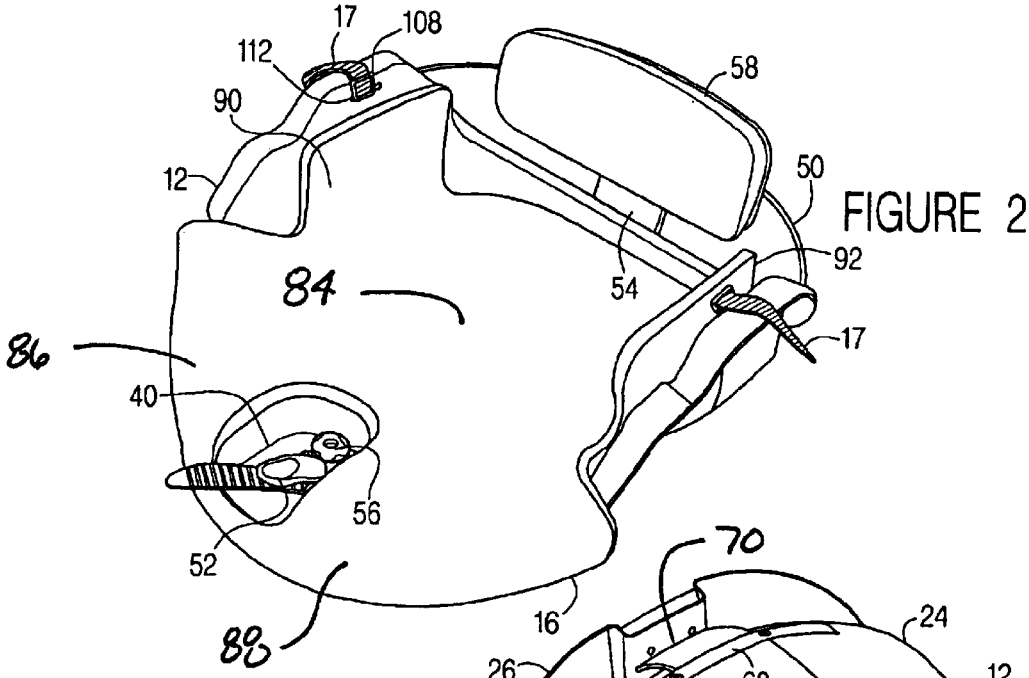
FIG. 2 is a top perspective view of the seating system of FIG. 1.
Figure 3A:
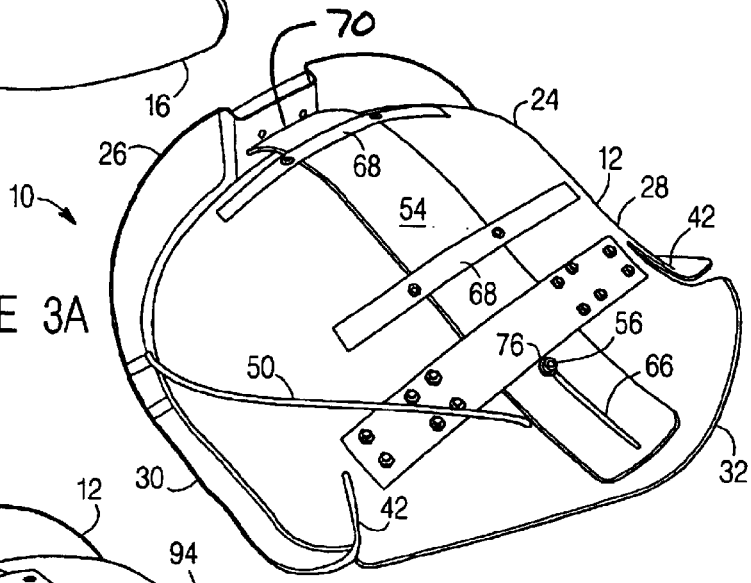
FIGS. 3A and 3B are bottom perspective views of seating systems according to exemplary embodiments.
Figure 3B:
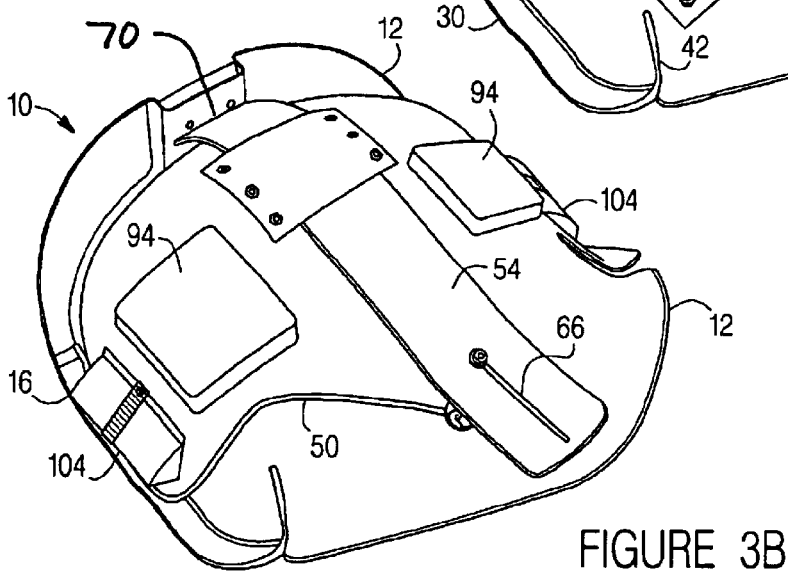
Figure 4:
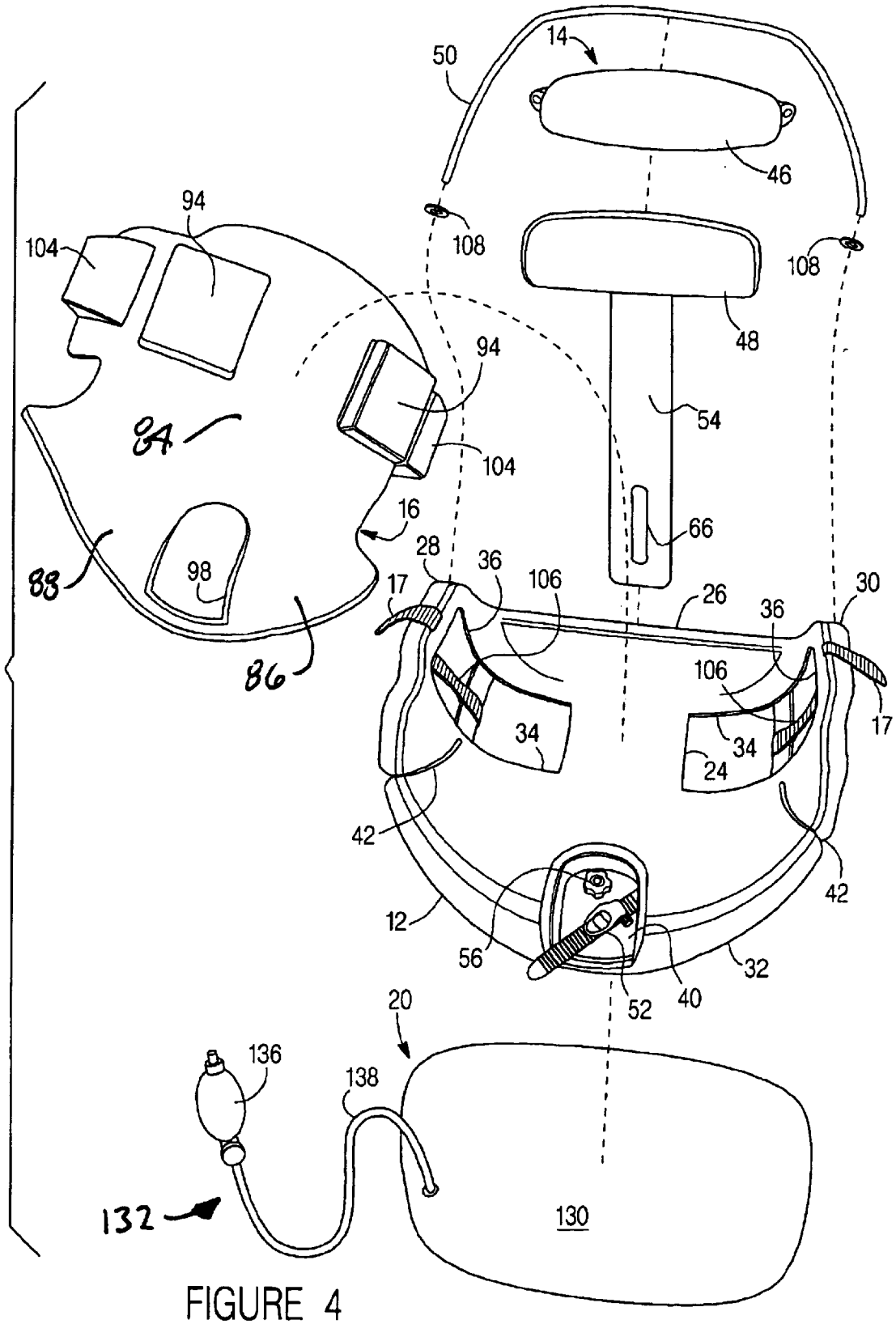
FIG. 4 is an exploded perspective view the seating system of FIG. 2.

FIGS. 1 and 2 are top perspective views of an exemplary embodiment of an adjustable seating system 10, seating system 10 generally includes seat pan 12, back rest 14, seat pad 16, hip adjusters 17, thigh braces 18, and tilt adjustment mechanism 20. Seat pan 12 generally serves as a base structure to which back rest 14 and pad 16 are mounted. Seat pan 12 further interacts with tilt adjustment mechanism 20 to vary the positioning of the kayaker's thighs against thigh braces 18. Seat pan 12 is best shown in FIGS. 4 and 3A, and 3B. Seat pan 12 generally includes central portion 24, back portion 26, side portions 28, 30, and front portion 32. In the embodiment illustrated, central portion 24, rear portion 26, side portions 28, 30, and front portion 32 are integrally formed as part of a single unitary body. Portions 24, 26, 28, 30 and 32 are preferably thermoformed from a rigid material such as polyethylene. Alternatively, portions 24, 26, 28, 30 and 32 may be individually formed and glued, fastened, welded or otherwise secured to one another or may be formed from a variety of alternative materials using a variety of alternative molding or fabrication techniques. Central portion 24 extends between portions 26, 28, 30 and 32 and forms a basin for supporting the kayaker's buttock. Central portion 24 preferably includes a pair of openings 34 adjacent side portions 28, 30. As will be described in greater detail thereafter, openings 34 receive portions of pad 16 to facilitate the retention of pad 16 relative to seat pan 12 above central portion 24 and to further permit pad 16 to extend below central portion 24 and seat pan 12 between seat pan 12 and the inner hull of the watercraft or other structure in which seating system 10 is employed. Alternatively, openings 34 may be omitted wherein pad 16 is merely glued, bonded, fastened or otherwise secured to seat pan 12 and wherein an additional pad is preferably secured to an underside of pan 12 between pan 12 and the watercraft.

Back portion or rear portion 26 extends opposite front portion 32 and extends upwardly from central portion 24. Back portion 26 provides a rear terminal point for seat pan 12 while providing the kayaker with some back support.

Side portions 28 and 30 extend on opposite sides of central portion 24 and are generally configured to be mounted to the hull of the kayak or watercraft in which seating system 10 is employed. Side portions 28 and 30 further serve as side terminal portions to seat pan 12. As further shown by FIG. 4, side portions 28 and 30 include openings 36. Openings 36 facilitate the adjustment of pad 16 to accommodate kayakers having different anatomies proximate the kayaker's hips and upper thighs. As will be appreciated, the exact size and shape of openings 34, as well as openings 36, may vary depending upon the exact configuration of the seating system.

Front portion 32 extends forwardly from central portion 24 and is configured to support a portion of pad 16 as well the kayaker's middle to lower thighs. Front portion 32 includes console 40 and tilt slots 42. Console 40 generally comprises a recess or cavity preferably centrally located between opposite sides of seat pan 12 along a frontwardmost portion of seat pan 12. Console 40 is preferably configured and located so as to be positioned between the kayaker's legs when the kayaker is seated in seating system 10. Console 40 receives adjustment controls for back rest 14. Because console 40 is recessed, such controls may be covered by a hatch cap. Alternatively, console 40 may not be recessed.

Tilt slots 42 comprise cuts or slits formed between front portion 32 and side portions 28, 30. Slots 42 facilitate pivotal movement of front portion 32 relative to central portion 24 and side portions 28, 30. In particular, slots 42 enable front portion to pivot about an integral or living hinge. As a result, front portion 32 may be pivoted upward and downward by tilt adjustment mechanism 20 to adjust the spacing between the upper surface of pad 16 and thigh braces 18. Alternatively, in lieu of pivoting about a living hinge, front portion 32 may be pivotably coupled to the remainder of seat pan 12 per various other pivoting mechanisms or structures such as hinges, pins and the like.

Once again referring to FIGS. 4 and 7, back rest 14 mounts to and generally extends rearwardly from seat pan 12. Back rest 14 includes back plate 46, pad 48, cable or rope 50, adjustment mechanism 52, tongue 54, and adjustment mechanism 56. Back plate 46 and pad 48 are joined or secured to one another to form an upper back support 58. FIG. 4 illustrates back support 58 in greater detail. Back plate 46 of back support 58 is a generally rigid member affixed to tongue 54. Back plate 46 includes scallops 60 and recess 62. Scallops 60 and recess 62 provide areas for facilitating gripping of back support 58. Recess 62 forms a handle area. As a result, back support 58 may be easily raised and lowered for adjustment. Pad 48 comprises a soft, compressible padding against which a seated kayaker's back rests.

Figure 7:
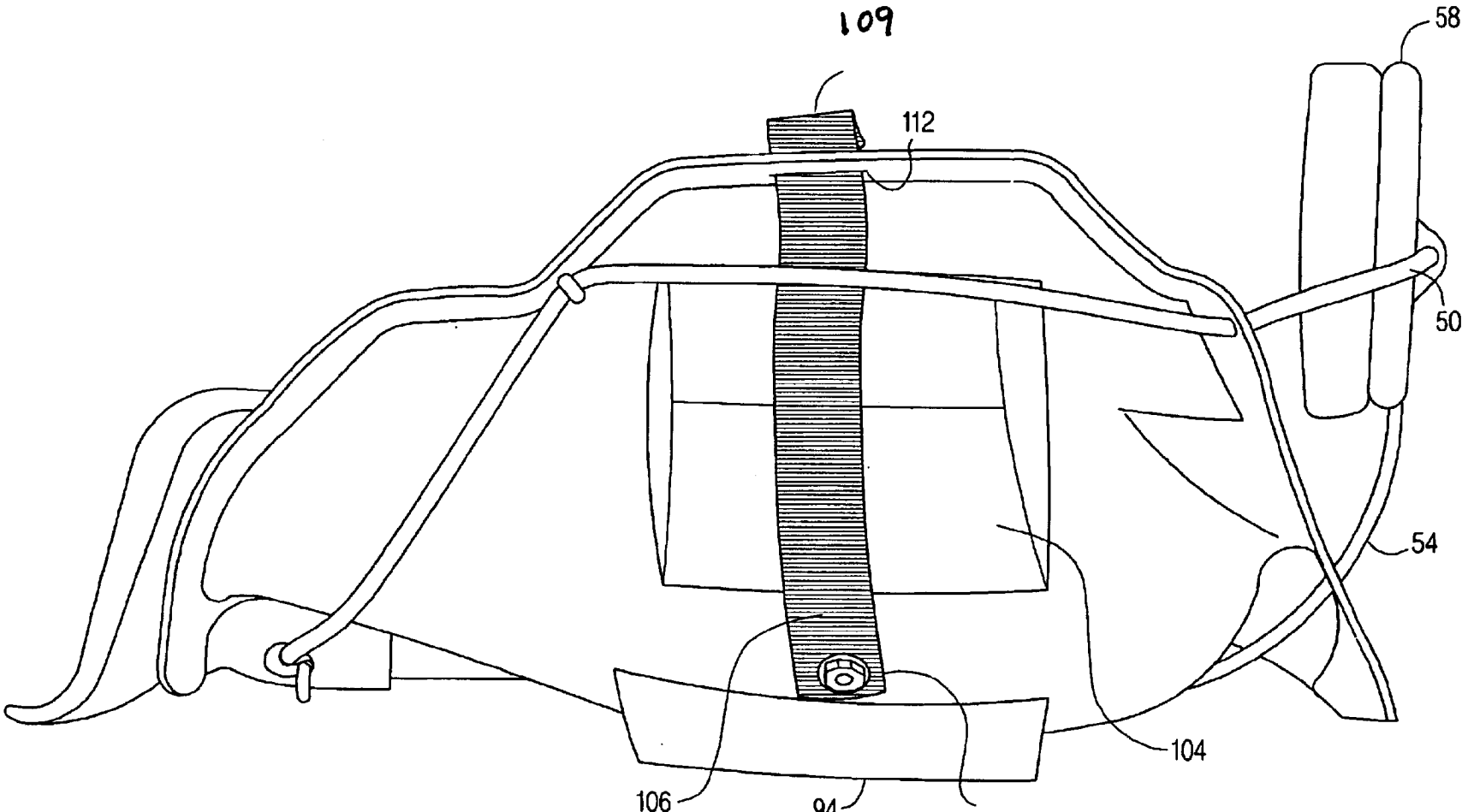
FIG. 7 is a side view of the seating system.

Rope 50 comprises a flexible member coupled to back support 58, threaded through portions of seat pan 12 and coupled to adjustment mechanism 52. In the exemplary embodiment, one end of rope 50 is affixed to seat pan 12 and the other end of rope 50 is secured to adjustment mechanism 52. In the exemplary embodiment, rope 50 is preferably threaded through back plate 46 as shown in FIG. 7. Alternatively, rope 50 may be coupled to back support 58 and further coupled to adjustment mechanism 52 by various other means and at or along various other locations.

Adjustment mechanism 52 is coupled to rope 50 and is located in console 40 of seat pan 12. Adjustment mechanism 52 is configured to adjust the length of rope 50 extending between back support 58 and seat pan 12 to adjust the tension of rope 50 and to adjust the fore and aft positioning of back support 58 relative to seat pan 12. Because adjustment mechanism 52 is located in console 40 of seat pan 12, this adjustment may be easily achieved by the kayaker while seated by simply reaching between his or her legs and accessing mechanism 52. Adjustment mechanism 52 preferably comprises a conventionally known straight cam-ratchet oriet consisting of a toothed belt secured to rope 50 and a cam pivotably coupled to seat pan 12. Alternatively, various other presently known or future developed mechanisms may be employed to adjust the length or tension of rope 50.

Tongue 54 extends between back support 58 and seat pan 12 to elevate back support 58 above seat pan 12. Tongue 54 is coupled to back support 58 comprises a strip of material having sufficient rigidity so as to support back support 58 in position above seat pan 12 while being borne against by a kayaker's back, yet flexible enough to enable tongue 54 to be slidably adjusted along seat pan 12. In the exemplary embodiment, tongue 54 is formed from a strip of polyethylene having a thickness of approximately 3/16ths of an inch. As will be appreciated, the thickness and material of tongue 54 may be varied depending upon the application. As further shown by FIG. 4, tongue 54 includes an elongate slot 66 sized for the reception of adjustment mechanism 56.

FIGS. 3A and 3B illustrate the securement of tongue 54 and back support 58 to seat pan 12. Seat pan 12 additionally includes straps 68 which are fastened to a bottom side of seat pan 12 so as to form aligned sleeves or guide ways for the slidable reception of tongue 54. Seat pan 12 additionally includes opening 70 extending through back portion 26 of seat pan 12. Tongue 54 slidably extends through opening 70 and the sleeves or guide ways provided by straps 68 such that slots 66 is positioned adjacent to and below console 40 of seat pan 12. Although tongue 54 is illustrated as being slidably supported and positioned by means of opening 70 and straps 68, various other structures or mechanisms may be used to slidably guide movement of tongue 54 relative to seat pan 12. For example, the underside of seat pan 12 may alternatively include integrally formed or molded guide ways.

Figure 6:
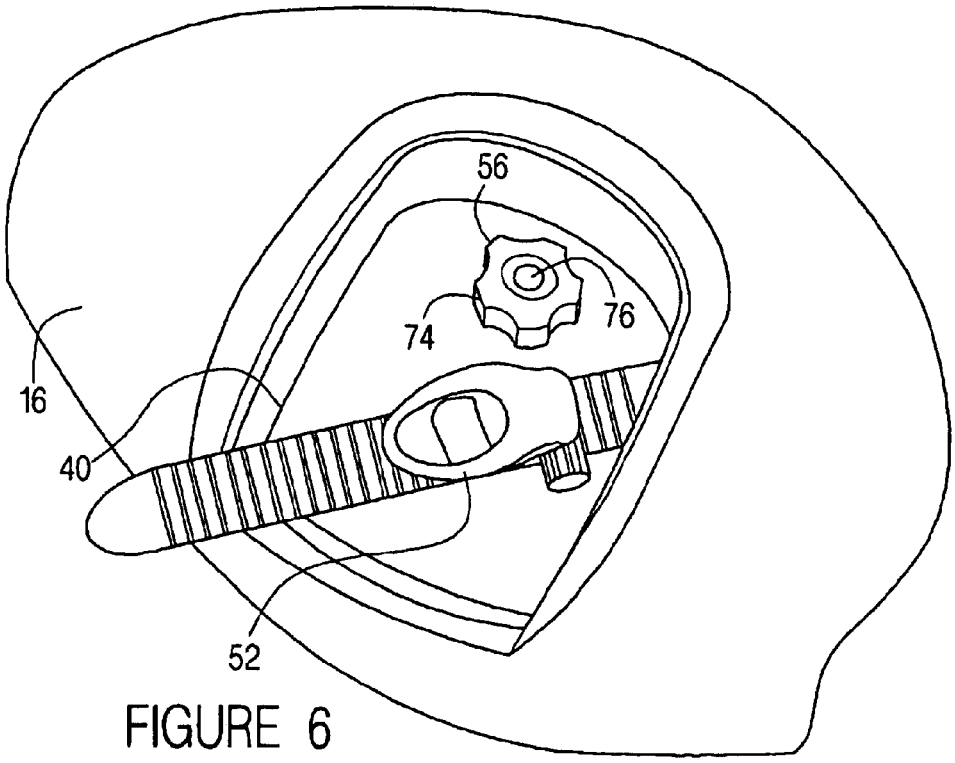
FIG. 6 is a fragmentary perspective view of a console and controls for an adjustment mechanism for the seating system.

FIG. 6 illustrates control mechanism 56 in greater detail. As shown by FIG. 6, control mechanism 56 comprises a member such as a thumb screw or knob 74 threadably engaging a bolt 76 passing through slot 66 and through seat pan 12. The rotation of knob 74 tightens or loosens bolt 76 against tongue 54 and against the underside of seat pan 12. To adjust a height of back support 58, the kayaker simply reaches down between his or her legs to console 40, turns knob 74 to loosen bolt 76, grasps back support 58 to slide tongue 54 along slot 66 to a desired height, and rotates knob 74 to re-tighten bolt 76 against tongue 54 and seat pan 12. As a result, the height of support 58 of back rest 14 may be easily adjusted to accommodate kayakers having different anatomies. This adjustment may be performed while the kayaker is generally seated within the kayak.

Although back rest 14 is illustrated as utilizing a bolt and knob received through a slot in tongue 54 to retain tongue 54 in any one of a plurality of positions along the axial length of slot 66 to provide back support 58 with a plurality of heights, various alternative mechanisms, presently known or future developed, may also be employed for allowing movement of tongue 54 and back support 58 between a plurality of positions and heights and for selectively retaining tongue 54 and back support 58 in one of a plurality of different positions and heights, respectively. For example, tongue 54 may alternatively be configured to ratchet between various positions wherein actuation of a knob located on control console 40 either releases the ratchet to enable tongue 54 to be slid or incrementally moves tongue 54. Various other adjustment and retention mechanisms may also be employed.

Figure 5:
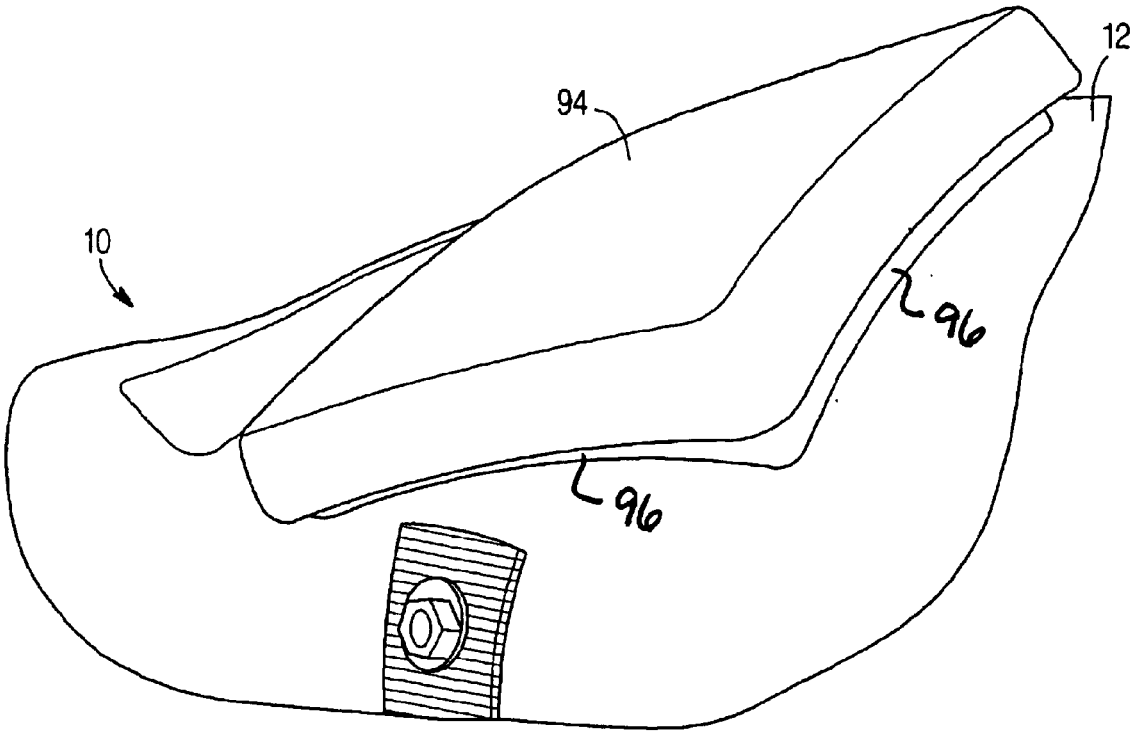
FIG. 5 is a fragmentary perspective view of a seat pan and seat pad for the seating system.

FIGS. 2 and 4 illustrate pad 16 in greater detail. Pad 16 preferably consists of a single unitary body of compressible material such as foam. Pad 16 preferably has a thickness sufficient so as to provide adequate cushioning so that a kayaker is seated upon pad 16 and seat pan 12. Pad 16 generally includes central portion 84, front portions 86, 88, and side or hip portions 90, 92. Central portion 84 generally comprises a portion of pad 16 configured to overlie central portion 24 of seat pan 12. Central portion 84 has a top surface configured to contact the kayaker and an opposite bottom surface bearing against seat pan 12. As best shown by FIG. 4, the bottom surface of central portion 84 includes projections 94. Projections 94 are sized and configured to extend through openings 34 (shown in FIGS. 4 and 5) of seat pan 12 and extend below seat pan 12. As shown by FIG. 5, each projection 94 preferably includes a groove or undercut 96 configured to receive the edge of seat pan 12 about a respective opening 34. Projections 94 engage seat pan 12 about openings 34 to retain pad 16 in place relative to seat pan 12. Although less desirable, undercuts 96 may be omitted. Projections 94 further extend below seat pan 12 to provide a cushioning layer between seat pan 12 and the inside surface of the hull of the watercraft in which system 10 is located. To further retain pad 16 relative to pan 12, adhesive, fasteners, welds, fusion bonds or other means may be additionally employed between pad 16 and pan 12. Moreover, in particular embodiments, pad 16 may be co-molded as part of seat pan 12. In alternative embodiments, projections 94 may be omitted wherein the lower surface of central portion 84 is simply secured to a bottom side of central portion 24.

Figure 9:
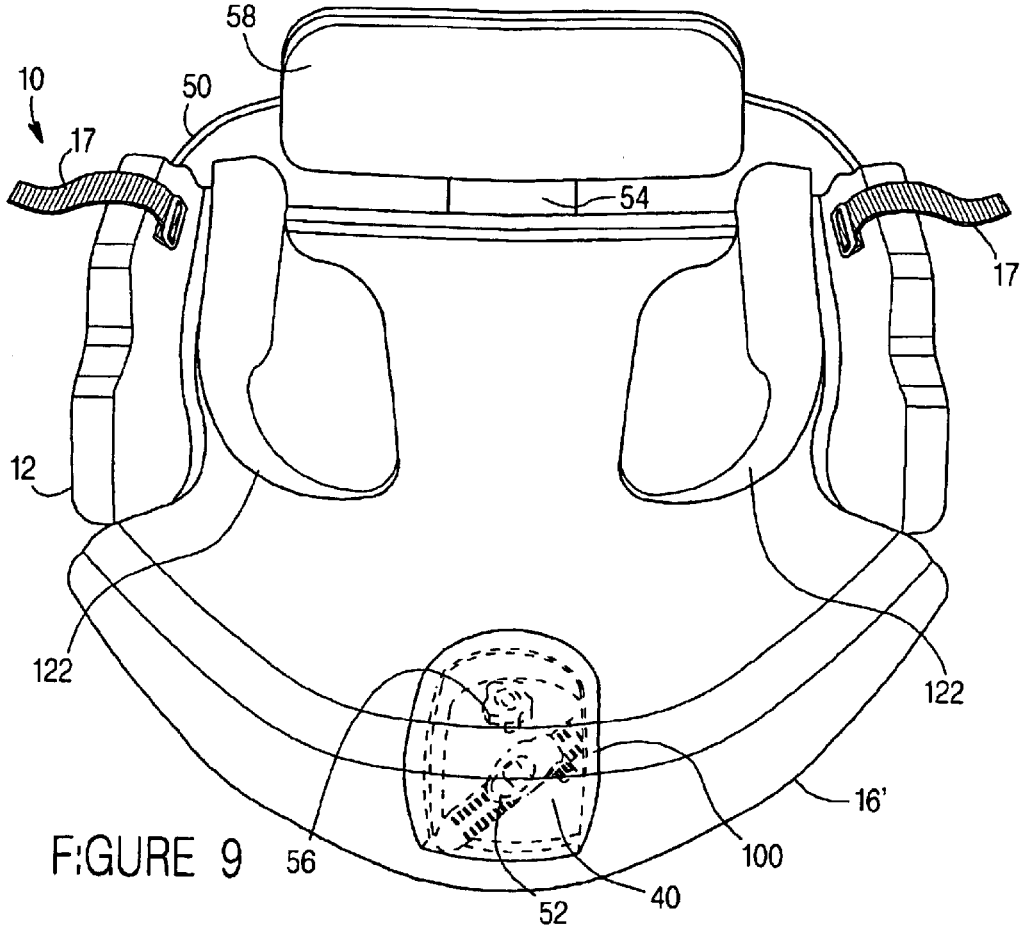
FIG. 9 is a seating system according to an alternative embodiment.

Front portions 86 and 88 of pad 16 are configured to overlie front portion 32 of seat pan 12. Front portions 86 and 88 extend on opposite sides of a central opening 98 formed therein which allows access to control console 40. Front portions 86 and 88 are also configured to pivot relative to central portion 84 enabling the top surfaces of front portions 86 and 88 to be adjustably spaced from side braces 18 (shown in FIG. 1). Although front portions 86 and 88 preferably pivot relative to central portion 84 about a natural living hinge created by the materials chosen for pad 16 and the relative thickness at the juncture of front portions 86, 88 and central portion 84, pivotal movement of front portions 86 and 88 may alternatively be enabled by other pivoting pins, hinges or similar structures. As shown by FIG. 9, pad 16 additionally includes a concealment panel or door 100 which removably fills or covers opening 98 and console 40 to prevent accidental actuation of mechanisms 52 and 56, to protect mechanisms 52 and 56 and to provide a padded surface for the kayaker to rest upon.

Side portions 90 and 92 extend upwardly from central portion 84 and are configured as well as located so as to engage the kayaker's hips and upper thighs when the kayaker is seated upon central portion 84. Although side portions 90 and 92 are described as generally flat planar surfaces, side portions 90 and 92 may be specifically contoured or shaped. Side portions 90 and 92 are preferably pivotable about one or more axes extending in a general fore and aft direction so as to conform to different anatomies of kayakers having different sized or shaped hips and upper thighs. In the particular embodiment illustrated, side portions 90 and 92 pivot and flex about a plurality of axes by means of a natural living hinge formed between side portions 90, 92 and central portion 84. Alternatively, side portions 90 and 92 may pivot about one or more such axes provided by other pivotal structures such as hinges and the like.

To facilitate movement and retention of side portions 90 and 92 between one of a plurality of different hip conforming positions, side portions 90 and 92 include side projections 104 which cooperate with hip adjusters 17 (shown in FIGS. 1 and 2). Side projections 104 generally comprise a portion extending outward from the remainder of pad 16. In the particular embodiment illustrated, projections 104 are preferably wedge-shaped and are configured to extend through openings 36 in seat pan 12. Although projections 104 are illustrated as being integrally formed with the remainder of pad 16, projections 104 may alternatively be glued, welded, fused, fastened or otherwise secured to the remainder of pad 16. Moreover, although projections 104 are illustrated as being formed of the same somewhat compressible material as that of pad 16, projections 104 may alternatively be formed from rigid, uncompressible and inflexible material. Although illustrated as being wedge shaped, projections 104 may alternatively have other configurations such that actuation of hip adjuster 17 causes inward movement or allows outward movement of the inner hip engaging surface portions of side portions 90 and 92.

FIGS. 2 and 7 illustrate pad 16 mounted to seat pan 12. In particular, FIG. 5 illustrates the underside of seat pan 12 with projections 94 extending through openings 34. As discussed above, projections 94 retain pad 16 relative to seat pan 12 and provide a cushioning layer below seat pan 12, between seat pan 12 and the inner surface of the hull in which seating system 10 is employed.

FIGS. 2 and 7 illustrate hip adjusters 17 and their interaction with projections 104. As best shown by FIG. 7, each of hip adjusters 17 generally includes strap 106 and buckle 108. Strap 106 generally comprises an elongate flexible member formed out of flexible material such as nylon. Strap 106 has a first end 107 secured to seat pan 12 generally below projection 104 and a second end 109 extending through buckle 108. Strap 106 further extends through a slot or opening 112 in seat pan 12 such that buckle 108 is positioned on an opposite side of seat pan 12. Buckle 108 comprises a conventionally known buckle receiving strap 106 and positioned on either an upper or interior surface of seat pan 12. Buckle 108 is preferably sized and configured so as to engage seat pan 12 in at least one orientation such that buckle 108 cannot pass through slot 112.

Figure 8:
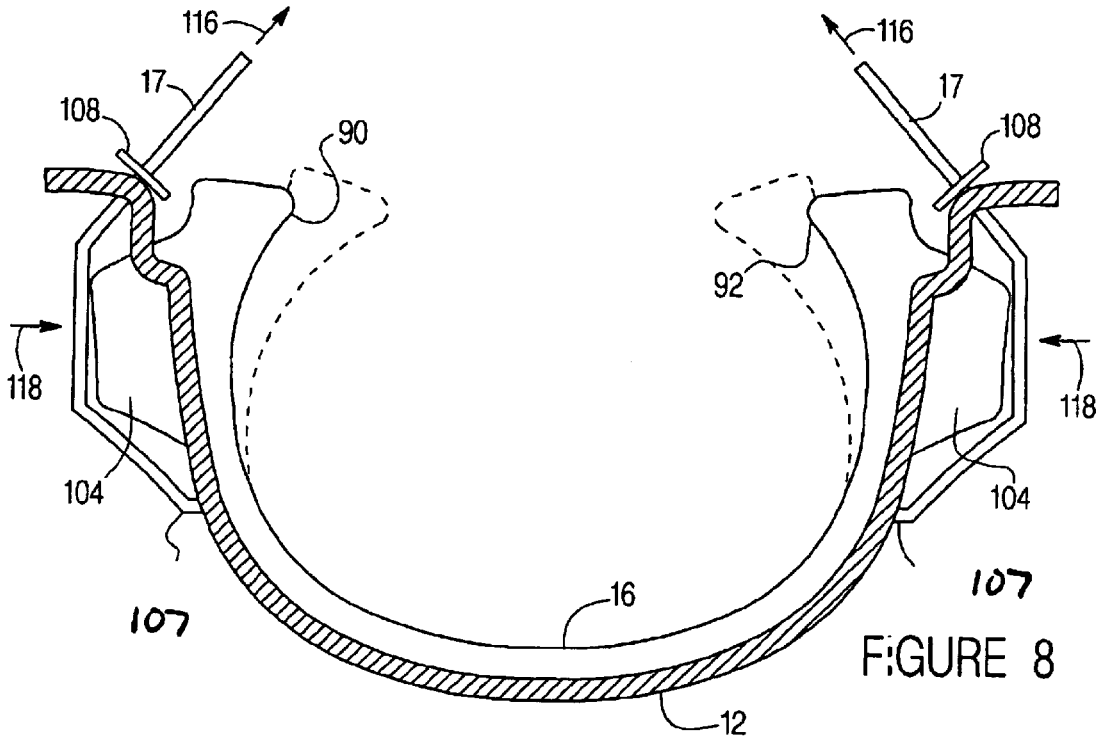
FIG. 8 is a sectional view of the seating system taken along the line 2—2.

As shown by FIG. 8, the hip conforming positioning of side portions 90 and 92 is adjusted by the kayaker pulling up or loosening straps 106 and adjusting the length of straps 106 between end 107 and slot 112 by means of buckle 108. In particular, to reduce the spacing between portions 90 and 92, a kayaker would simply pull up on straps 106 in the direction indicated by arrows 116 shown in FIG. 8. As a result, straps 106 would exert an inward force upon projections 104 in the directions indicated by arrows 118. This inward force would cause portions 90 and 92 to "squeeze in" about the kayaker as shown in FIG. 8. Once a comfortable hip-conforming position was attained, strap 106 is pulled through buckle 108 until buckle 108 abuts seat pan 12 adjacent slot 112 to retain portions 90 and 92 in place.

To enlarge or increase the spacing between portions 90 and 92, the reverse operation would be necessary. In particular, the kayaker would first pull strap 106 through buckle 108 to increase the length of strap 106 extending between slot 112 and end 107. This relaxation of strap 106 would allow portions 90 and 92 to move outward away from one another as the kayaker presses against portions 90 and 92.

Although hip adjusters 17 are illustrated as including a strap 106, buckle 108 and slot 112, hip adjusters 17 may comprise a variety of alternative mechanisms or structures which cause inward or outward movement of portions 90 and 92. For example, in lieu of utilizing buckle 108, hip adjusters 17 may use structures integrally formed with seat pan 12 to releasably retain strap 106 in one of a multitude of positions. In lieu of strap 106, a belt having teeth or more detent structures could be employed wherein the detent structures engage a male projection mounted to or integrally formed as part of seat pan 12, thus enabling releasable securement of the belt in a variety of positions. In yet another alternative embodiment, strap 106 and buckle 108 may be omitted wherein inflatable bags or bellows are positioned adjacent projections 104 outside seat pan 12 between projections 104 and either an additional structure coupled to pan 12 or between pan 12 and the outer hull of the watercraft such that inflation and deflation of the bag causes inward and outward movement of portion 90 or 92. In another alternative embodiment, openings 36 may be omitted such that seat pan 12 is generally imperforate, wherein the airbag or other linear actuators could be disposed between the inner surface of seat pan 12 and portions 90 and 92 of pad 16 to actuate portions 90 and 92 inwardly or outwardly as desired. Although each of the aforementioned alternatives performs the same advantageous functions, such alternative embodiments are less preferred due to possible complexity.

FIG. 9 illustrates an alternative pad 16' for use in seating system 110. Pad 16' is identical to pad 16 except that pad 16' additionally includes contoured portions 122. Contour portions 122 better conform to the shape of the kayaker's hips and upper thighs. Portions 122 are preferably inserts which are releasably attached to the remainder of pad 16'. Alternatively, portions 122 may be integrally formed with the remainder of pad 16' or otherwise permanently attached to the remainder of pad 16'. For example, yet another alternative pad may be provided in which portions 122 are integrally formed with the remainder of pad 16".

FIGS. 1 and 4 illustrate adjustment mechanism 20 in greater detail. As shown by FIG. 4, adjustment mechanism 20 generally comprises an inflatable bag 130 and an inflation/deflation mechanism 132. Inflatable bag 130 is configured to be located below front portion 32 of seat pan 12 and such that controls for an inflation/deflation mechanism 132 are accessible. Bag 130 preferably is dimensioned such that when fully or at least partially inflated, bag 130 lifts or elevates front portion 32 sufficiently close to thigh braces 18 such that different kayakers, regardless of their individual and distinct thigh dimensions, are snugly positioned against thigh braces 18 by appropriate inflation of bag 130. Deflation of bag 130 further allows the kayaker to easily exit the kayak or other watercraft.

Figure 14:
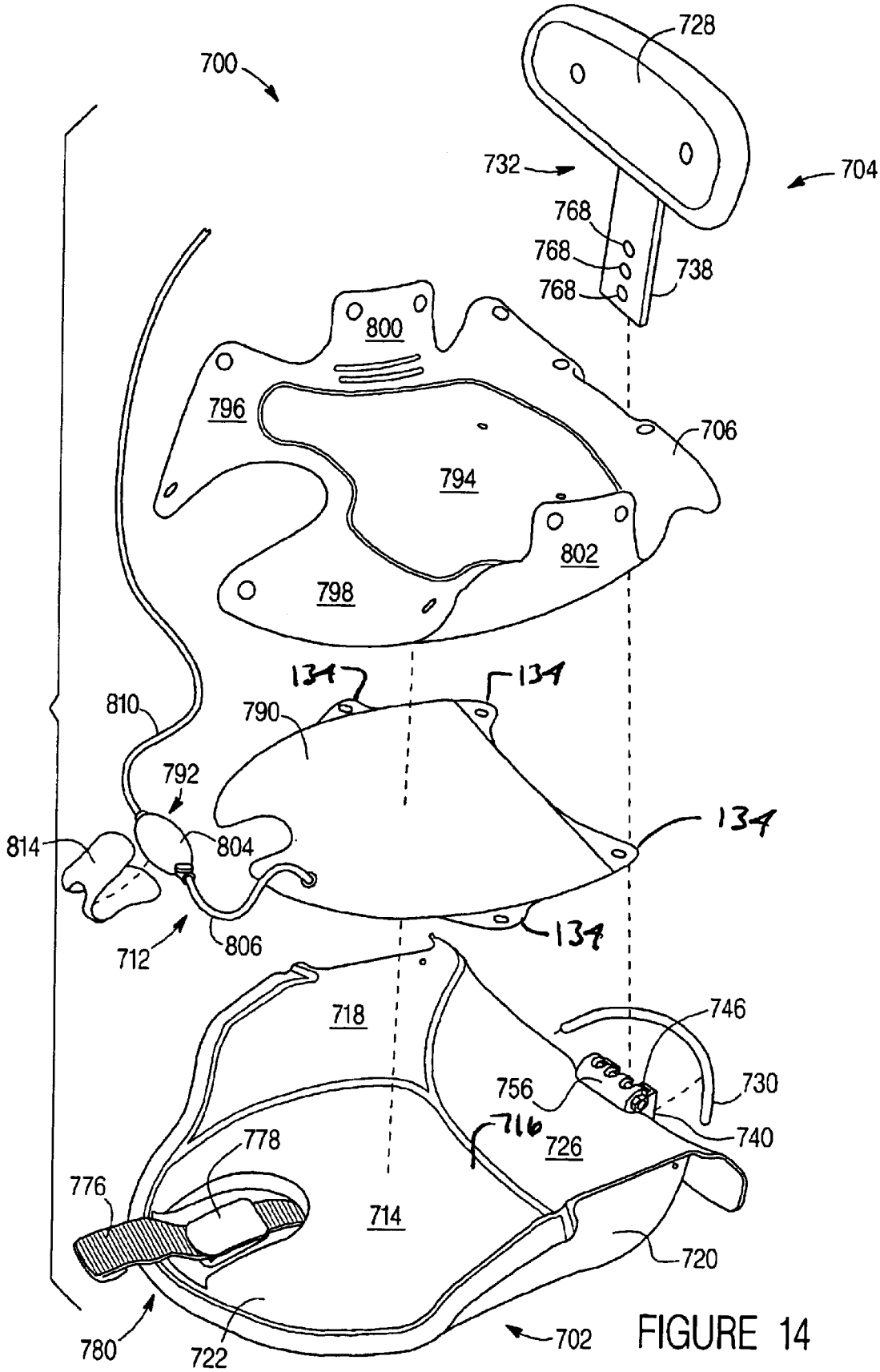
FIG. 14 is an exploded view of the seating system of FIG. 13.

FIG 4. illustrates one preferred embodiment of mechanism 20. In particular, FIG. 4 illustrates bladder or bag 130. As shown by FIG. 14, bag 130 includes mounting portions 134 which facilitate securement of bag 130 to seat pan 12. Mounting portions 134 may be secured to seat pan 12 by fasteners such as rivets, welds, adhesives, stitches or fusion joints. Moreover, mounting portions may alternatively be secured to the hull or other watercraft below front portion 32 of seat pan 12.

Inflation/deflation mechanism 132 preferably comprises a hand-held pump 136 pneumatically connected to bag 130 by means of tube 138. As will be appreciated, a variety of presently known or future developed alternative inflation and/or deflation mechanisms may be employed to selectively at least partially inflate or at least partially deflate bag 130. Such mechanisms may be manually operated or operated by a power source. In alternative embodiments, bag 130 may be inflated or deflated by other gases other than air or by various fluids. Furthermore, in lieu of utilizing an inflatable or deflatable bag, various other actuators, whether hydraulic, pneumatic, electrical or the like may be employed to selectively raise and lower front portion 32 of seat pan 12 or alternatively to directly raise or lower the front portion of pad 16.

FIG. 1 illustrates seating system 10 deployed within watercraft 140 (shown as a conventionally known sit-in kayak). As shown by FIG. 1, thigh braces 18 are secured to watercraft 140 slightly forward and above seat pan 12 and pad 16. Thigh braces 18 are configured to brace the kayaker's thighs and upper legs. As shown by FIG. 1, inflation of bag 130 pivots front portion 32 of seat pan 12 and overlying pad 16 to elevate the kayaker's thighs towards thigh braces 18. Likewise, deflation of bag 130 allows front portion 32 to fall away from the lower surface of thigh braces 18. Consequently, selective inflation and deflation of bag 130 enables seating system 10 to accommodate different kayakers having different anatomies and to allow the kayaker's thighs to be snugly and securely positioned between seat pan 12 or pad 16 and thigh braces 18 while the kayaker assumes a comfortable, relaxed posture within the watercraft 140. In the exemplary embodiment, the controls of inflation/deflation mechanism 132 extend above pad 16 are easily accessible to the kayaker while the kayaker is seated. In alternative embodiments, the controls of inflation/deflation mechanism 132 may alternatively be integrally formed or mounted to portions of seating system 10 or portions of watercraft 140. Likewise, if other mechanisms are used to selectively raise and lower the front portion of pad 16 and seat pan 12, controls for such actuation mechanisms may also be integrally formed with or mounted to portions of seating system 10 or watercraft 140. In lieu of utilizing an airbag, other pneumatic, hydraulic or electrical actuators may be employed to selectively move portions 90 and 92 inward and outward.

Figure 10:
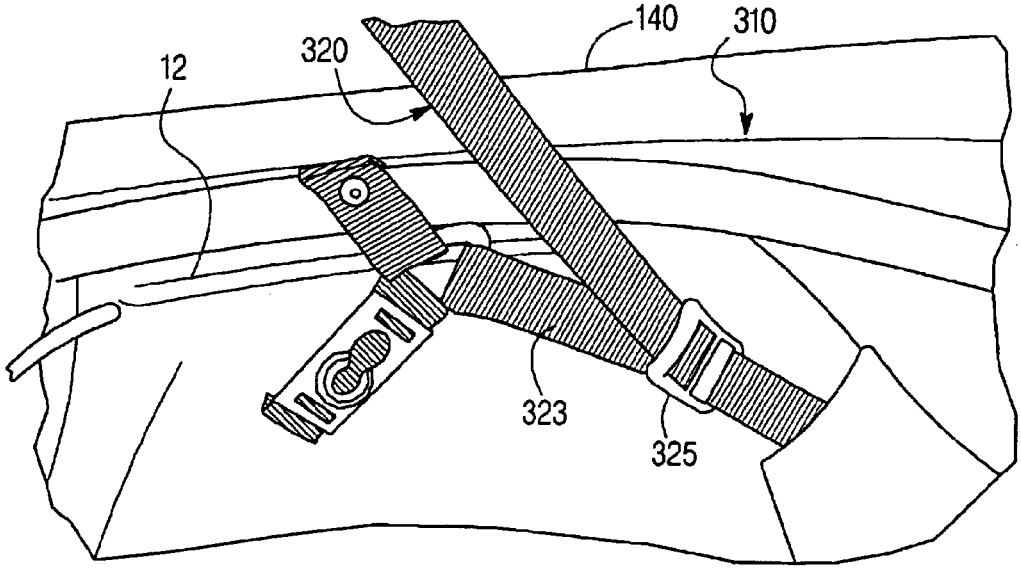
FIG. 10 is a seating system according to another alternative embodiment.

FIG. 10 illustrates seating system 310, a first alternative embodiment of seating system 10 mounted to a watercraft 140 (shown as a conventional sit-in kayak). Seating system 310 is substantially identical to seating system 10 except that seating system 310 includes adjustment mechanism 320 in lieu of adjustment mechanism 20. Adjustment mechanism 320 generally comprises an elongate strap 323 mounted to opposite sides of seat pan 12 (shown with certain portions omitted or as being incomplete) and extending through guides (not shown) below front portion 32 of seat pan 12. Strap 323 is composed of one or more segments configured so as to have an adjustable length. In the particular embodiment illustrated, strap 323 includes two portions joined together by buckle 325. By pulling or releasing strap 323 through buckle 325, front portion 32 of seat pan 12 may be pivoted upward or downward to raise pad 16. As a result, the kayaker can assure himself or herself a snug comfortable fit of his or her thighs against thigh braces 18 by adjusting the length of strap 323.

Figure 12:
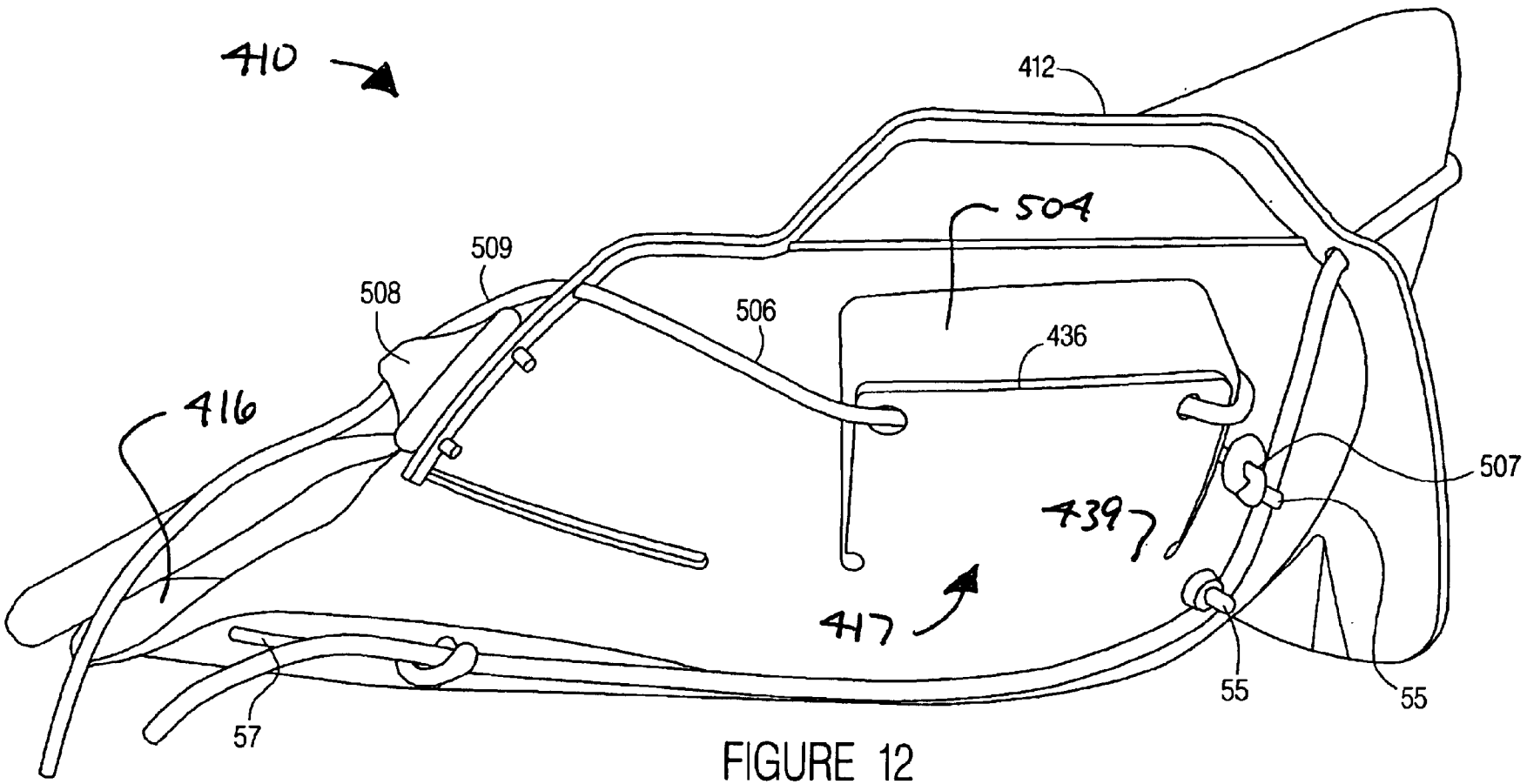
FIG. 12 is a seating system according to another alternative embodiment.

FIG. 12 illustrates seating system 410, a second alternative embodiment of seating system 10. Seating system 410 is substantially identical to seating system 10 except that seating system 410 includes seat pan 412, pad 416 and hip adjusters 417 in lieu of seat pan 12, pad 16 and hip adjusters 17, respectively. The remaining components of seating system 410, which are substantially similar to corresponding components of seating system 10, are numbered similarly.

In addition to illustrating the distinctions between seating system 410 and seating system 10, FIG. 12 further illustrates the connection of rope 50 and adjustment mechanism 52 in greater detail. In particular, FIG. 12 illustrates rope 50 secured to back support 58. Rope 50 extends from back support 58 to adjustment mechanism 52. As shown by FIG. 12, rope 50 extends through guides 55 along the exterior of seat pan 412 (seat pan 12 when employed in system 10) prior to being tied to belt 57 of adjustment mechanism 52. Belt 57 extends through an opening in the seat pan and in releasable engagement with the cam ratchet oriet located in console 40.

As best shown by FIG. 3A, seat pan 412 is similar to seat pan 12 (positioned beside seat pan 412 in FIG. 3A) except that central portion 24 omits openings 36 and is generally imperforate. As a result, in seating system 410, pad 416 is glued, bonded, fastened or otherwise secured to the upper surface of central portion 24 of seat pan 412. In addition, a separate pad member is also secured to an underside of seat pan 412.

In contrast to seat pan 12, seat pan 412 has side portions 28, 30 that include partially severed flaps 436 in lieu of openings 36. As shown by FIG. 12, flaps 436 are configured to pivot relative to side portions 28 and 30 about a generally fore and aft extending axis to facilitate movement of pad 416 inward and outward to accommodate differently sized hips. In the particular embodiment illustrated, flaps 436 pivot by means of a living flexible hinge 439 formed at the base of each of flaps 436. This hinge is the result of the particular material chosen for seat pan 12, the relative thickness of the material of seat pan 12 adjacent flaps 436 and the cuts forming flap 436. Alternatively, flap 436 may be formed by other materials distinct from the remaining material forming seat pan 412 to provide the living hinge. Moreover, flaps 436 may alternatively be pivotally supported adjacent to the remainder of seat pan 412 by other pivoting structures such as hinges and the like.

Pad 416 is similar to pad 16 except that pad 416 includes side portions 90 and 92 which include side projections 504 in lieu of side projections 104. Side projections 504 are configured to at least partially contact or be supported by flaps 436 such that side portions 504 pivot about hinge 439 inward and outward beyond the remainder of side portions 28 and 30 of seat pan 412 as flaps 436 are being pivoted by hip adjusters 417. In the particular embodiment illustrated, portions 504 are affixed to flaps 436 by adhesives. Alternatively, fasteners, welds, fusion bonds or other affixing means may be employed to secure portions 504 to flaps 436.

FIG. 12 best illustrates hip adjusters 417. As shown by FIG. 12, each hip adjuster 417 generally comprises a flexible member 506 (shown as a cable or rope) having a first end 507 coupled to seat pan 412 on a first rearward side of flap 436, having an intermediate length threaded through flap 436 and having a second end 509 threaded through seat pan 412 and releasably engaging gripper 508. Gripper 508 is mounted to seat pan 412 along a forward portion of side portions 28, 30 of pan 412. Each gripper 508 includes a central channel having cleats configured to releasably engage and retain rope 506 in place. To reduce the spacing between side portions 90 and 92 of pad 416, the kayaker either pulls rope 506 further through gripper 508 or lifts rope 506 from gripper 508 and pulls rope 506 such that flap 436 and projections 504 pivot inwardly. Once a desired location is attained for side portions 90 and 92, rope 506 is reinserted in gripper 508 if initially withdrawn. Alternatively, to increase the spacing between side portions 90 and 92, the kayaker withdraws rope 506 from gripper 508 and exerts an outward force against side portions 90 and 92 such that flaps 436 and projections 504 pivot outwardly to a desired position. Once the desired position is attained, the kayaker reinserts rope 506 in gripper 508.

Although gripper 508 is illustrated as an elastomeric member having a channel including one-way teeth or cleats configured to allow movement of rope 506 in a single direction while rope 506 is within the channel and also configured to allow rope 506 to be moved perpendicularly to the teeth such that rope 506 can be lifted from the channel, gripper 508 may alternatively comprise any of a variety of alternative presently known or future developed structures or mechanisms mounted to seat pan 12 or integrally formed as part of seat pan 12 which are configured to releasably retain a flexible member, such as a rope, cable or belt.

Figure 11:
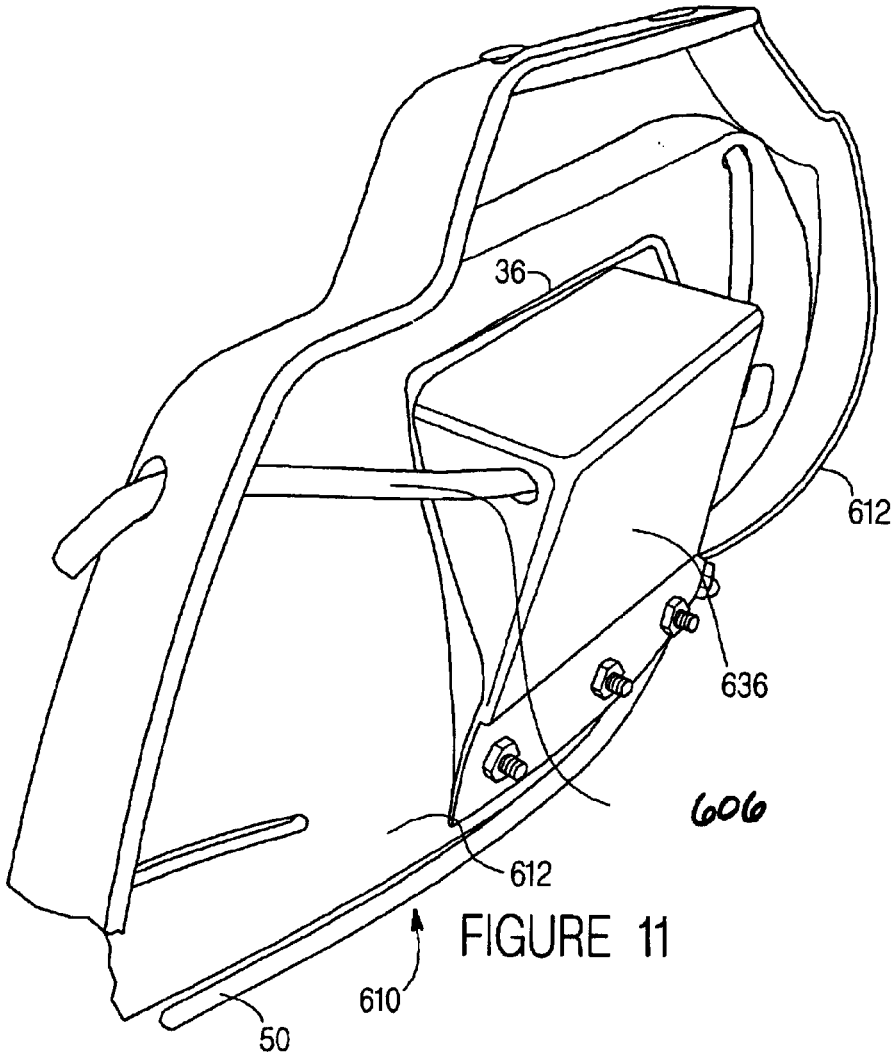
FIG. 11 is a seating system according to another alternative embodiment.

FIG. 11 illustrate seating system 610, a third alternative embodiment of seating system 10. Seating system 610 is similar to seating system 410 except that seating system 610 includes seat pan 612 in lieu of seat pan 412. Seat pan 612 is similar to seat pan 412 except that seat pan 612 includes pivoting actuation members 636 in lieu of flaps 436. Members 636 comprise three-dimensional structures mounted to seat pan 612 adjacent to openings 36 and coupled to rope 606. Like flaps 436, members 636 are configured to pivot inwardly and outwardly relative to the adjacent seat pan so as to contact and move portions of the pad inwardly and outwardly to accommodate different kayaker hip sizes. Although members 636 are illustrated as being generally triangular in shape, members 636 may have a variety of alternative shapes or configurations. Moreover, although members 636 are illustrated as being mounted to seat pan 612, members 636 may alternatively be integrally formed as part of seat pan 612 or mounted to seat pan 612 by various other methods. In lieu of relying upon a living hinge to enable each member 636 to pivot, members 636 may alternatively pivot about other means such as hinges and the like. As will further be appreciated, structures 636 may alternatively be solid three-dimensional structures, hollow three-dimensional structures, single walled three-dimensional structures and may be formed from materials distinct from the material chosen for seat pan 612.

Seating systems 10, 310, 410 and 610 illustrate but a few examples of potential feature combinations. In particular, systems 10, 310, 410 and 610 illustrate seating structures or arrangements that (1) have a back support or back rest having a height and a fore and aft position that are both adjustable by means of control mechanisms located in one or more consoles or locations that are easily accessible to the kayaker while the kayaker is seated, (2) have padded side portions which are sideways adjustable to accommodate kayakers having different hip sizes, wherein such adjustment is achieved by manipulation of easily accessible controls or mechanisms, and (3) have a seat with a front portion (whether padded or not padded) that pivots to ensure a snug, yet comfortable fit of the kayaker's thighs against thigh braces regardless of the particular anatomy of the kayaker's thighs. Each of these features may be employed in alternative embodiments independent of one another or in differing combinations with one another. Furthermore, such features may have a variety of alternative looks, dimensions and configurations depending upon the particular application. Moreover, although each of the aforementioned features is specifically disclosed in combination with one another as part of a seating system for use with a kayak or watercraft, it is contemplated that such features, alone or in combination with one another, may alternatively be employed as part of other seating arrangements or as part of other products that may require the seat to securely yet comfortably retain a seated person or child in place. For example, it is contemplated that such features may have particular uses in child restraining vehicle or car seats, amusement park rides and other similar articles of manufacture. Although the particular embodiments illustrated are currently viewed as the present best mode for such a seating system for a sit-in kayak, minor modifications may be required for other such applications.

Figure 13:
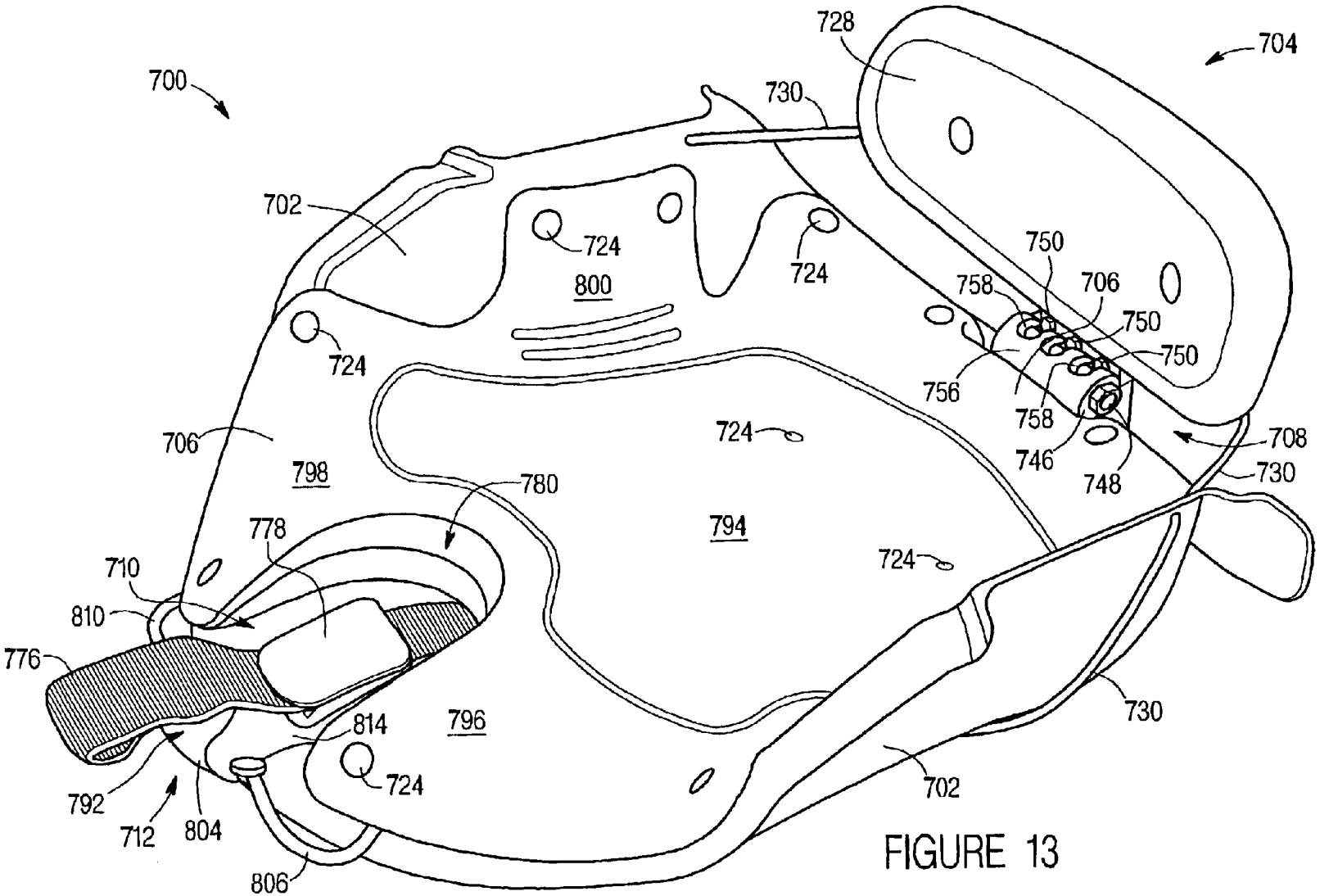
FIG. 13 is a perspective view of a seating system according to a preferred embodiment.

FIG. 13 is a top perspective view of a preferred embodiment of an adjustable seating system 700. Seating system 700 generally includes a seat pan 702, a back rest 704, a seat pad 706, a back rest adjustment mechanism 708, a fore/aft adjustment mechanism 710, and a seat pad adjustment mechanism 712.

Seat pan 702 generally serves as a base structure to which back rest 704, seat pad 706, and adjustment mechanisms 708, 710, 712 are mounted. Seat pan 702 generally includes a central portion 714, a back portion 716, side portions 718, 720, and a front portion 722. Central portion 714 extends between portions 716, 718, 720, and 722 and forms a basin for supporting the kayaker's buttocks. In the embodiment illustrated, central portion 714, back portion 716, side portions 718, 720, and front portion 722 are integrally formed as part of a single unitary body. Portions 714, 716, 718, 720 and 722 are preferably thermoformed from a rigid material such as polyethylene. Alternatively, portions 714, 716, 718, 720 and 722 may be individually formed and glued, fastened, welded or otherwise secured to one another or may be formed from a variety of alternative materials using a variety of alternative molding or fabrication techniques.

According to a preferred embodiment, one or more pads 725 are secured to an underside of seat pan 702 (glued, bonded, fastened or otherwise secured to bottom of seat pan 702) between seat pan 702 and the watercraft.

Figure 16:
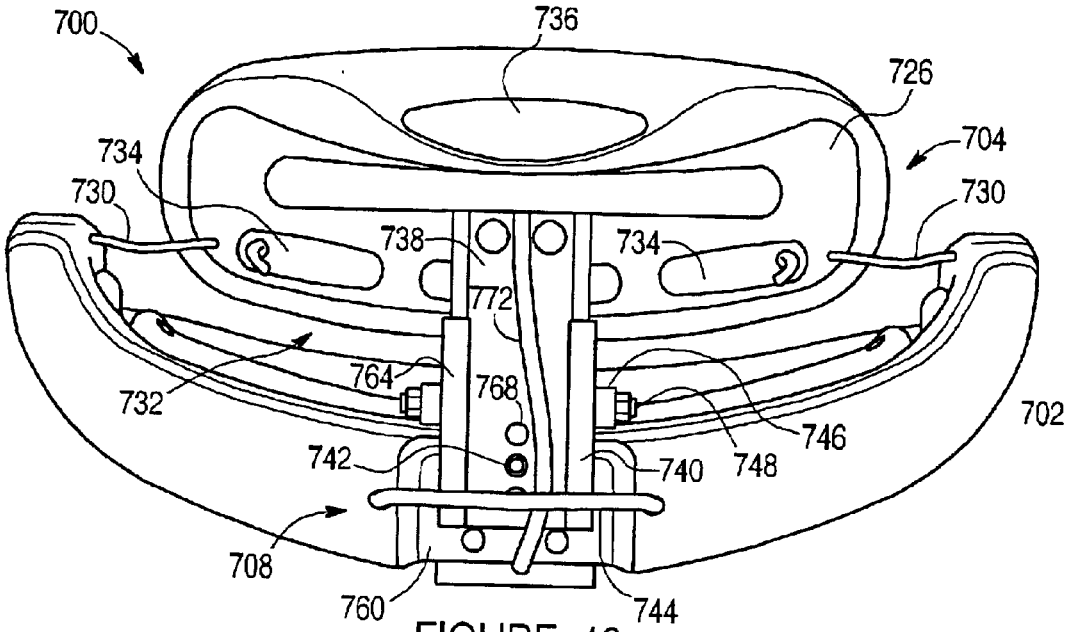
FIG. 16 is a rear elevation view of the seating system of FIG. 13.
Figure 18:
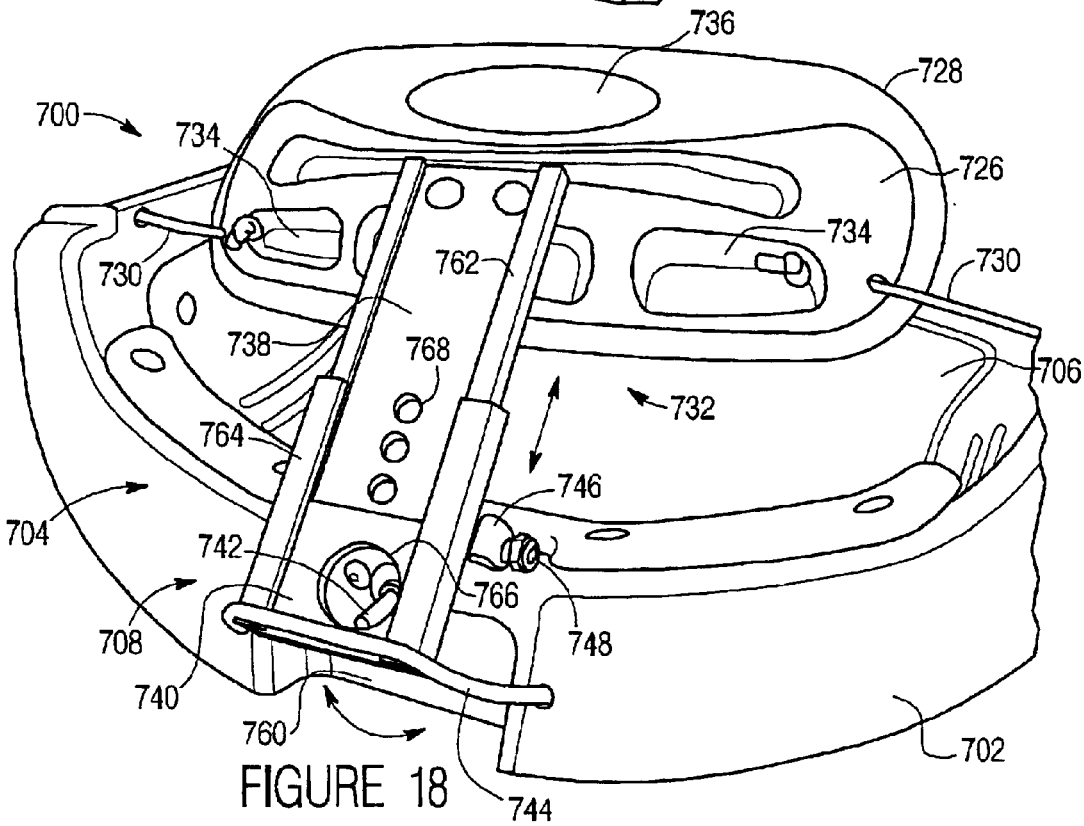
FIG. 18 is a perspective view of a back rest of the seating system pivoted to disengage the back rest adjustment mechanism.

Referring to FIGS. 14, 16, and 18, back rest 704 mounts to and generally extends upwardly from seat pan 702. Back rest 704 includes a back plate 726, a pad 728, a rope 730 (e.g., cable or cord) and adjustment mechanism 708. Back plate 726 and pad 728 are joined or secured to one another to form an upper back support 732. Back plate 726 is a generally rigid member affixed to back rest adjustment mechanism 708. Back plate 726 includes scallops 734 and recess 736. Scallops 734 and recess 736 provide areas for facilitating gripping of back support 732 (e.g., during egress or ingress of watercraft, during adjustment of back rest 704 position, leverage, etc.). Recess 736, for example, forms a handle area. Pad 728 comprises a soft, compressible padding against which a seated kayaker's back rests.

Back support 732 may be quickly and easily adjusted (i.e., raised and lowered) by operation of back rest adjustment mechanism 708. Adjustment mechanism 708 includes an upper member 738 (shown as a "C"-shaped channel), a lower member 740 (shown as a "C"-shaped channel), a locking pin 742, and a biasing member 744.

Upper member 738 is coupled to back plate 726. Preferably, upper member 738 is coupled to back plate 726 by a pair of fasteners engaging a bar or plate (not shown) disposed between back plate 726 and pad 728. (Alternatively, upper member 738 is glued, bonded, fastened or otherwise secured to back plate 726.)

Lower member 740 is pivotally coupled to seat pan 702 by a bracket 746 and a pivot pin 748. Bracket 746 is coupled to a major side of lower member 740 by a pair of fasteners 750 (e.g., screws, rivets, bolts, pins, etc.). Pivot pin 748 extends through apertures in brackets 746 and openings in a protrusion 756 extending from rear side of seat pan 702. Protrusion 756 further includes openings or recesses 758 adjacent fasteners 750 to prevent interference when back rest 726 is pivoting. Preferably, protrusion 756 is integrally formed with seat pan 702, but may be provided by a separate component (e.g., a bracket) attached to seat pan 702. The lower portion of lower member 740 is disposed in a recess 760 formed in seat pan 702 when lower member is in the generally vertical position.

Referring to FIG. 18, upper member 738 and lower member 740 are preferably both "C"-shaped and include flange portions 762, 764 that provide opposed channels along their sides. Flange portions 762 of upper member 738 is sized and configured to engage (e.g., "capture") flange portions 764 of lower member 740. As such, upper member 738 can slide within and relative to lower member 740.

Locking pin 742 extends from seat pan 702, through an opening 766 in lower member 740. Locking pin 742 engages an aperture 768 in upper member 738 so that upper member 738 is prevented from sliding within lower member 740. Locking pin 742 is mounted to a rear side of seat pan 702 in recess 760. Preferably, locking pin 742 is coupled to a plate 770 that is attached to an inside surface of seat pan 702. According to a particularly preferred embodiment, rivets are used to secure locking pin 742 and plate 770 to seat pan 702. Alternatively, any of a variety of fasteners (e.g., nuts and bolts or screws), clips, or the like may be used. According to a particularly preferred embodiment, upper and lower members 738, 740 and plate 770 are made from aluminum, and locking pin 742 is made from stainless steel. Alternatively, any of a variety of metals or plastics may be used.

A strap 772 couples back support 732 and seat pan 702 so that upper member 738 does not inadvertently disengage lower member 740 during adjustment.

Biasing member 744 (shown as a "shock" or "bungee" cord) biases lower member 740 against rear surface within recess 760 of seat pan 702. Preferably, biasing member 744 passes through apertures in rear of seat pan 702 on either side of recess 760 and held in place by knots in ends of the bungee cord (though fasteners, clamps, and other devices may be used).

To adjust the height of back support 732, the kayaker simply pivots back rest 704 about pivot pin 748 (e.g., by gripping and urging back support 732 towards the front of the seat) until upper member 738 is pivoted far enough so that locking pin 742 disengages upper member 738 (i.e., would not prevent upper member 738 from sliding within lower member 740 (see FIG. 18). After aperture 768 "clears" locking pin 742, the upper member 738 can then be adjusted so that locking pin 742 engages a different aperture 768 in upper member 738. As shown in the FIGURES, there are four height adjustment positions provided by the three apertures 768 and the bottom edge of upper member 738. As a result, the height of back support 732 of back rest 704 may be easily adjusted to accommodate kayakers having different anatomies. This adjustment may be performed while the kayaker is generally seated within the kayak.

Figure 15:
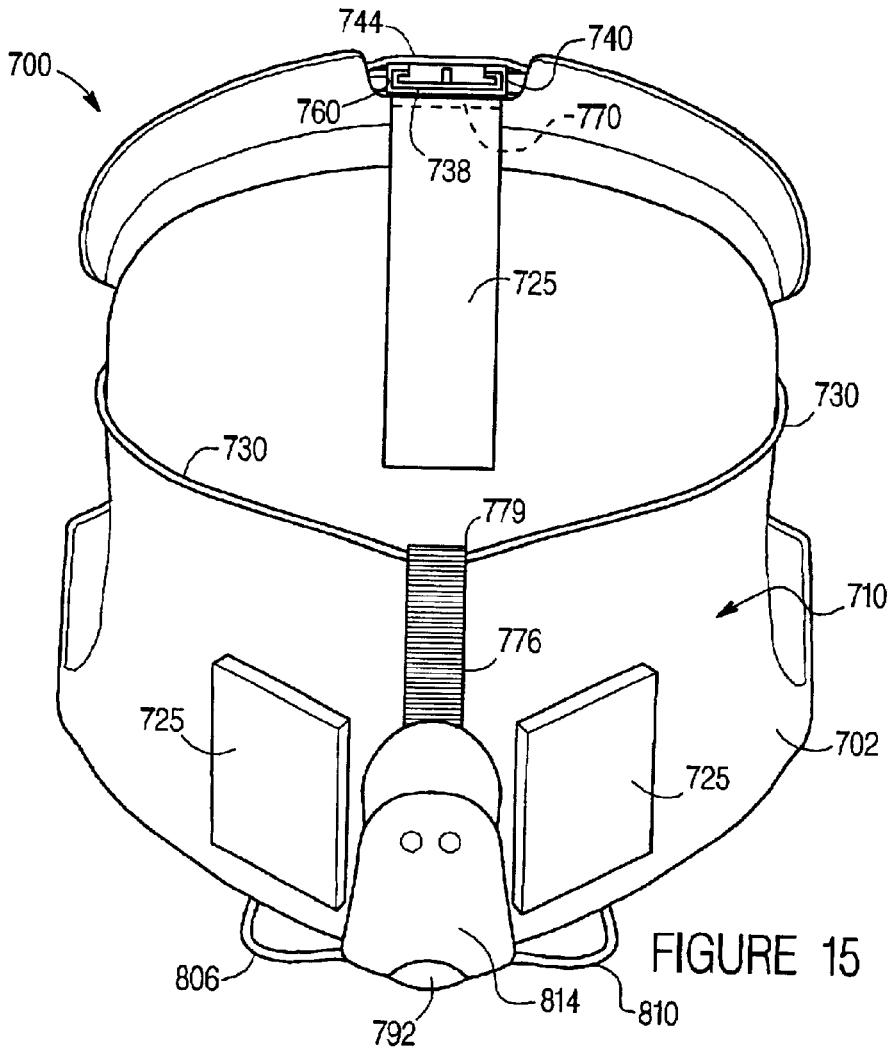
FIG. 15 is a bottom view of the seating system of FIG. 13.
Figure 17:
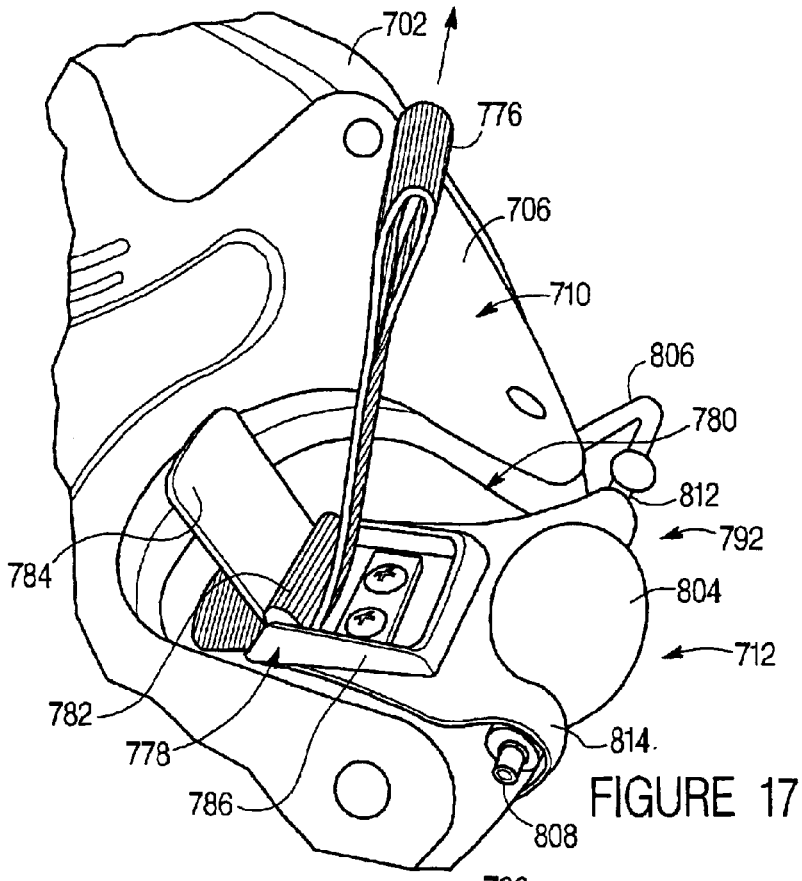
FIG. 17 is a fragmentary perspective view of a console and controls for adjustment mechanisms.

Referring to FIGS. 13, 15, and 17, fore/aft adjustment mechanism 710 includes a strap 776 (shown as a two-inch web material) and a control mechanism 778. Adjustment mechanism 710 is configured to provide fore and aft seating position adjustment by pivoting back rest 704 towards or away from the front of the seat. When back rest 704 is pivoted towards the front of the seat, the user's natural seating position is located forward.

A rope 730 (e.g., cable, cord, etc.) comprises a flexible member coupled to back support 732, thread through portions of seat pan 702 and coupled to fore/aft adjustment mechanism 710. In an exemplary embodiment, one end of rope 730 is affixed to an end of back plate 726 of back rest 704, and the other end of rope 730 is secured to the other end of back plate 726 of back rest 704. Rope 730 is also threaded through a loop 779 formed in strap 776 (e.g., sewn, adhesive, welded, bonded, fasteners, etc.). According to a preferred embodiment, rope 730 passes through a tube located to within loop 779 (e.g., to reduce wear on strap 776 and reduce friction between the rope and strap interface). Alternatively, rope 730 may be coupled to back support 732 and further coupled to adjustment mechanism 710 by various other means and at or along various other locations. According to a particularly preferred embodiment, rope 730 is commercially available as Spectra rope or cord.

To adjust the fore/aft seating position, the length of rope 730 extending between back support 732 and seat pan 702 is adjusted (e.g., by applying or releasing tension of rope 730). Adjustment of the length of rope adjusts the fore and aft positioning of back support 732 relative to seat pan 702. Because end of strap 776 and control device 778 of adjustment mechanism 710 is located in a console 780 of seat pan 702, this adjustment is quickly and easily achieved by the kayaker while seated by simply reaching between his or her legs and accessing adjustment mechanism 710.

Control mechanism 778 comprises a device such as a conventionally known as a cam-lock buckle or device configured to releasably engage strap 776. The cam-lock device includes a ribbed or toothed cam portion 782 and a lever 784 pivotally coupled to a base plate 786 mounted to seat pan 702 in console 780. (Alternatively, various other presently known or future developed mechanisms may be employed to adjust the length or tension of rope 730.) Strap 776 passes through seat pan 702 and between base plate 786 and cam portion 782 of the cam-lock device. Cam portion 782 engages strap 776 when lever 784 is in a generally horizontal position. To release or disengage strap 778, lever is pivoted until cam portion 782 releases strap.

Although adjustment mechanism 710 is illustrated as utilizing a cam-lock device to releasably engage or retain strap 776 in any one of a plurality of positions along the axial length of strap to provide back support 732 with a plurality of fore and aft positions, various alternative mechanisms, presently known or future developed, may also be employed for allowing movement of strap 776 and back support 732 between a plurality of positions and heights and for selectively retaining strap 776 and back support 732 in one of a plurality of different positions. For example, strap 776 may alternatively be configured to ratchet between various positions wherein actuation of a knob located on console 780 either releases the ratchet to enable strap 776 to be slid or incrementally moves strap 780. Various other adjustment and retention mechanisms may also be employed.

Referring to FIGS. 13–15 and 17, seat pad adjustment mechanism 712 is shown according to a preferred embodiment. Seat pad adjustment mechanism 712 is configured to vary the positioning of the kayaker's thighs against thigh braces 788 and comprises an inflatable bag 790 and an inflation/deflation mechanism 792. Inflatable bag is configured to fill voids between kayaker and seat pad 706 (e.g., reduce pressure points by increasing area the weight is distributed across), and to provide more comfortable support to kayaker, regardless of their individual and distinct buttock and thigh dimensions. Also, inflation of bag 790 is configured to lift or elevates seat pad 706 so that the kayaker's thighs are snugly positioned against thigh braces 788. Deflation of bag 790 further allows the kayaker to easily exit the kayak or other watercraft.

Seat pad 706 preferably comprises a single unitary body of compressible material such as foam. Seat pad 706 preferably has a thickness sufficient so as to provide adequate cushioning so that a kayaker is seated upon seat pad 706 and seat pan 702. Seat pad 706 generally includes a central portion 794, front portions 796, 798, and side or hip portions 800, 802. Central portion 794 generally is configured to overlie central portion 714 of seat pan 702. Central portion 794 has a top surface configured to contact the kayaker and an opposite bottom surface bearing against bag 790.

Seat pad 706 is coupled to seat pan 702 by fasteners 724 (preferably by push-in or "Christmas tree" fasteners but may be any of a variety of fastener or joining device). Alternatively, seat pad 706 is merely glued, bonded, fastened or otherwise secured to seat pan 702. Alternatively, seat pad 706 is retained relative to seat pan 702 by any of a variety of methods, e.g., adhesive, fasteners, welds, fusion bonds or other means may be additionally employed between seat pad 706 and seat pan 702. In alternative embodiments, seat pad 706 may include projections extending from the lower surface of central portion 794 and through openings in seat pan 702.

Inflatable bag 790 is configured to be located below seat pad 706, and dimensioned substantially the same as seat pad 706. As will be appreciated, a variety of presently known or future developed alternative inflation and/or deflation mechanisms may be employed to selectively at least partially inflate or at least partially deflate bag 790. Such mechanisms may be manually operated or operated by a power source. In alternative embodiments, bag 790 may be inflated or deflated by other gases other than air or by various fluids. Furthermore, in lieu of utilizing an inflatable or deflatable bag, various other actuators, whether hydraulic, pneumatic, electrical or the like may be employed to selectively raise and lower front portion of seat pan or alternatively to directly raise or lower the front portion of pad.

Inflation/deflation mechanism 792 preferably comprises a hand pump 804 pneumatically connected to bag 790 by means of a tube 806 coupled to an exhaust port 808 of pump 804. According to an exemplary embodiment, another tube 810 is coupled at one end to intake port 812. The other end (not shown) of tube 810 is located so that if the seating space is filled with water, water is not pumped into bag 790 (e.g., to provide a snorkel effect). Preferably, the other end of tube 810 is disposed on the side of the seat above seat pan 702. According to an exemplary embodiment, the other end is attached to a kayak cockpit covering. Alternatively the other end extends outside of the watercraft. Inflation/deflation mechanism 792 is retained by a harness 814 coupled to seat pan 702. Preferably, harness 814 is made from a urethane coated nylon such as Hypalon material, but other materials can be used (which are preferably UV resistant, strong, and flexible). As will be appreciated, a variety of presently known or future developed alternative inflation and/or deflation mechanisms 792 may be employed to selectively at least partially inflate or at least partially deflate bag 790. Such mechanisms may be manually operated or operated by a power source. In alternative embodiments, bag 790 may be inflated or deflated by other gases other than air or by various fluids. Furthermore, in lieu of utilizing an inflatable or deflatable bag, various other actuators, whether hydraulic, pneumatic, electrical or the like may be employed to selectively raise and lower front portions 796, 798 of seat pan 702 or alternatively to directly raise or lower the front portion of seat pad 706.

Seating system 700 is configured to be deployed within watercraft (such as a conventionally known sit-in kayak). As shown by FIG. 1, thigh braces 788 are secured to watercraft slightly forward and above seat pan 702 and seat pad 706. Thigh braces 788 are configured to brace the kayaker's thighs and upper legs. Inflation of bag 790 lifts and elevates seat pad 706 to fill voids between kayaker and seat pad 706 and to elevate the kayaker's thighs towards thigh braces 788. Consequently, selective inflation and deflation of bag 790 enables seating system 700 to accommodate different kayakers having different anatomies and to allow the kayaker's thighs to be snugly and securely positioned between seat pad 706 and thigh braces 788 while the kayaker assumes a comfortable, relaxed posture within the watercraft. In the exemplary embodiment, the controls of inflation/deflation mechanism 792 extend above seat pad 706 are easily accessible to the kayaker while the kayaker is seated. In alternative embodiments, the controls of inflation/deflation mechanism 792 may alternatively be integrally formed or mounted to portions of seating system 700 or portions of watercraft. In lieu of utilizing an airbag, other pneumatic, hydraulic or electrical actuators may be employed to selectively move portions 794, 796, 798, 800, 802 inward and outward.

It is also important to note that the construction and arrangement of the elements of the adjustable seating system as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, while the components of the disclosed embodiments will be illustrated as an adjustable seat designed for a kayak, the features of the disclosed embodiments have a much wider applicability. For example, the adjustable seat design is adaptable for other watercraft and recreational products. Further, the size of the various components and the size of the containers can be widely varied. Also, the particular materials used to construct the exemplary embodiments are also illustrative. For example, injection molded high density polyethylene is the preferred method and material for making the top and base, but other materials can be used, including other thermoplastic resins such as polypropylene, other polyethylenes, acrylonitrile butadiene styrene ("ABS"), polyurethane nylon, any of a variety of homopolymer plastics, copolymer plastics, plastics with special additives, filled plastics, etc. Also, other molding operations may be used to form these components, such as blow molding, rotational molding, etc. Some components of the adjustable seat system can also be manufactured from stamped alloy materials such as steel or aluminum. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A seating system for use in a watercraft and configured to provide an adjustment seating position for a user of the watercraft, the seating system comprising:

a seat pan adapted to be mounted to the watercraft;

a pad coupled to the seat pan and adapted to provide a seating surface for the user;

a back rest coupled to the seat pan;

a first adjustment mechanism configured to provide fore and aft adjustment of the seating position;

a second adjustment mechanism configured to provide adjustment of the back rest without having to exit the watercraft; and a third adjustment mechanism configured to provide adjustment of the seating surface.

2. The seating system of claim 1 wherein the first adjustment mechanism comprising a first member coupled to the back rest and a second member pivotally coupled to the seat pan, wherein the back rest, first member and second member pivot between a first position where the back rest is retained in place and a second position where the first member and back rest are slidably movable relative to the second member.

3. The seating system of claim 1 wherein the second adjustment mechanism comprises a strap and a locking device, the strap having a first end coupled to the back rest and a second end releasably retained by the locking device.

4. The seating system of claim 1 wherein the third adjustment mechanism is configured to provide adjustment of the seating surface wherein the seating surface is movable between a first position and a second position.

5. A seating system for use in a watercraft and configured to provide a seating position for a user of the watercraft, the seating system comprising:

a seat pan adapted to be mounted to the watercraft;

a pad coupled to the seat pan and adapted to provide a seating surface for a user of the watercraft;

a back rest coupled to the seat pan;

an adjustment mechanism configured to provide height adjustment to the back rest, the adjustment mechanism comprising a first member coupled to the back rest and a second member pivotally coupled to the seat pan, wherein the back rest, first member and second member pivot between a first position where the back rest is retained in place and a second position where the first member and back rest are slidably movable relative to the second member.

6. The seating system of claim 5 wherein the second member is pivotally coupled to the seat pan by a bracket and a pin.

7. The seating system of claim 5 wherein in the adjustment mechanism further comprises a pin that engages an aperture when the back rest, first member, and second member are in the first position.

8. The seating system of claim 7 wherein the pin extends from the seat pan.

9. The seating system of claim 8 wherein the aperture is located on the first member.

10. The seating system of claim 5 further comprising a biasing device that urges the second member towards the first position.

11. The seating system of claim 10 wherein the biasing device is a bungee cord.

12. A seating system for use in a watercraft and configured to provide an adjustment seating position for a user of the watercraft, the seating system comprising:

a seat pan adapted to be mounted to the watercraft;

a pad coupled to the seat pan and adapted to provide a seating surface for a user of the watercraft;

a back rest coupled to the seat pan;

an adjustment mechanism configured to provide fore and aft adjustment of the seating position, a rope coupling the back rest to the adjustment device;

wherein the adjustment mechanism comprises a strap and a locking device, the strap having a first end coupled to the rope and a second end releasably retained by the locking device.

13. The seating system of claim 12 wherein the fore and aft adjustment is provide by pivotal movement of the back rest.

14. The seating system of claim 13 wherein the back rest is pivotal between a first position and a second position, wherein the first position of the back rest provides a forward seating position and the second position provides a rearward seating position.

15. The seating system of claim 12 wherein the locking device is a camlock buckle.

16. A seating system for use in a watercraft and configured to provide a seating position for a user of the watercraft, the seating system comprising:

a seat pan adapted to be mounted to the watercraft;

a pad coupled to the seat pan and adapted to provide a seating surface for a user of the watercraft;

a back rest coupled to the seat pan;

an adjustment mechanism configured to provide adjustment of the seating surface wherein the seating surface is movable between a first position and a second position.

17. A seating system for use in a watercraft and configured to provide a seating position for a user of the watercraft, the seating system comprising:

a seat pan adapted to be mounted to the watercraft;

a pad coupled to the seat pan and adapted to provide a seating surface for a user of the watercraft;

a back rest coupled to the seat pan;

an adjustment mechanism configured to provide adjustment of the seating surface wherein the seating surface is movable between a first position and a second position, wherein the adjustment mechanism comprises an inflatable bag and an inflation mechanism coupled to the inflatable bag.

18. The seating system of claim 17 wherein the inflation mechanism is located at a front portion of the seat pan.

19. The seating system of claim 17 wherein the inflatable bag is located between the pad and the seat pan.

20. The seating system of claim 17 wherein the inflatable bag is located between the seat pan and the watercraft.

21. The seating system of claim 17 further comprising a first tube coupling the inflation mechanism to an exhaust port of the inflatable bag.

22. The seating system of claim 17 further comprising a second tube coupled to an intake port of the inflation mechanism.

23. The seating system of claim 16 wherein the adjustment mechanism comprises one or more straps configured to alter the configuration of the seat pad.

24. The seating system of claim 23 wherein the seat pad comprises hip pad portions and the one or more straps are configured to move the hip portions between a first position and a second position.

25. A seating system for use in a watercraft and configured to provide a seating position for a user of the watercraft, the seating system comprising:

a seat pan adapted to be mounted to the watercraft;

a pad coupled to the seat pan and adapted to provide a seating surface for a user of the watercraft;

a back rest coupled to the seat pan;

a means for adjusting the height of the back rest;

a means for adjusting the fore and aft sitting position; and a means for adjusting the support provided by the pad.

26. The seating system of claim 25 wherein the means for adjusting the height of the back rest comprises a first member coupled to the back rest and a second member pivotally coupled to the seat pan, wherein the back rest, first member and second member pivot between a first position where the back rest is retained in place and a second position where the first member and back rest are slidably movable relative to the second member.

27. The seating system of claim 25 wherein the means for adjusting the fore and aft sitting position comprises a strap and a locking device, the strap having a first end coupled to the back rest and a second end releasably retained by the locking device.

28. The seating system of claim 25 wherein the means for adjusting the support provided by the pad is configured to provide adjustment of the seating surface wherein the seating surface is movable between a first position and a second position.

29. A method of adjusting a seating position provided by a seating system for use in a watercraft, the method comprising:

providing a seat pan adapted to be mounted to the watercraft, a pad adapted to provide a seating surface for a user, a back rest coupled to the seat pan, and a first adjustment mechanism;

operating the first adjustment mechanism to provide fore and aft adjustment of the seating position of the user;

operating a second adjustment mechanism configured to provide adjustment of the back rest without having to exit the watercraft; and operating a third adjustment mechanism configured to provide adjustment of the seating surface.

30. The seating system of claim 29 wherein operating the second adjustment mechanism comprises pivoting the back rest to disengage a locking mechanism and selectively adjusting the height of the back rest.

31. The seating system of claim 29 wherein operating the first adjustment mechanism comprises disengaging a buckle, adjusting the length of a strap that extends from the buckle, and engaging the buckle.

32. The seating system of claim 29 wherein operating the third adjustment mechanism comprises altering the seating surface.

33. The seating system of claim 32 wherein altering the seating surface comprises inflating an inflatable bag.

34. The seating system of claim 32 wherein altering the seating surface comprises adjusting one or more straps.

* * * * *